US010066794B2

(12) United States Patent
Maglica et al.

(10) Patent No.: US 10,066,794 B2
(45) **Date of Patent: *Sep. 4, 2018**

(54) RECHARGEABLE LIGHTING DEVICES

(71) Applicant: Mag Instrument, Inc., Ontario, CA (US)

(72) Inventors: Anthony Maglica, Ontario, CA (US); Benny M Osorio, Ontario, CA (US); Stacey H West, Ontario, CA (US)

(73) Assignee: MAG INSTRUMENT, INC, Ontario, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/833,942

(22) Filed: Dec. 6, 2017

(65) Prior Publication Data

US 2018/0106437 A1 Apr. 19, 2018

Related U.S. Application Data

(63) Continuation of application No. 15/596,986, filed on May 16, 2017, now Pat. No. 9,851,061, which is a continuation of application No. 14/490,622, filed on Sep. 18, 2014, now Pat. No. 9,671,098.

(60) Provisional application No. 61/879,596, filed on Sep. 18, 2013.

(51) Int. Cl.

| | |
|---|---|
| ***F21L 4/00*** | (2006.01) |
| ***F21L 13/00*** | (2006.01) |
| ***F21L 4/08*** | (2006.01) |
| ***F21V 23/04*** | (2006.01) |
| *F21Y 115/10* | (2016.01) |
| *F21V 29/70* | (2015.01) |

(52) U.S. Cl.

CPC ..... *F21L 4/085* (2013.01); *F21V 23/0421* (2013.01); *F21V 29/70* (2015.01); *F21Y 2115/10* (2016.08)

(58) Field of Classification Search

CPC ..... F21L 4/085; F21L 4/08; F21V 23/0421; F21V 29/70; F21Y 2115/10

USPC ..... 362/183, 208

See application file for complete search history.

(56) References Cited

U.S. PATENT DOCUMENTS 5,498,949 A * 3/1996 Dowe ..... H02J 7/0031 320/128
9,671,098 B2 * 6/2017 Maglica ..... F21V 23/0414
9,851,061 B2 * 12/2017 Maglica ..... F21L 4/085
(Continued)

*Primary Examiner* — Anh Mai
*Assistant Examiner* — Glenn Zimmerman
(74) *Attorney, Agent, or Firm* — Roy L. Anderson

(57) ABSTRACT

A charging process of a rechargeable lighting device is controlled by a software algorithm and a microcontroller configured within the rechargeable lighting device which has first and the second charging contacts located on its exterior and the charging circuit is turned on when a cradle detection circuit detects that at least one of the charging contacts engages an electrical contact when the rechargeable lighting device is inserted into a charging cradle. The charging process begins with a charge-current which is constant and a battery charge-voltage which rises up to a nominal battery charge-voltage. The rechargeable lighting device recovers to a preselected condition through use of a power interruption avoidance algorithm configured within the microcontroller when there is a loss of power to the microcontroller of less than a preselected amount of time.

12 Claims, 21 Drawing Sheets

(56) References Cited

U.S. PATENT DOCUMENTS

| | | | | |
|---|---|---|---|---|
| 2005/0002186 | A1* | 1/2005 | Krieger | F21L 4/027<br>362/183 |
| 2005/0237734 | A1* | 10/2005 | Krieger | F21L 4/027<br>362/157 |
| 2006/0120069 | A1* | 6/2006 | West | F21L 4/005<br>362/157 |
| 2006/0193128 | A1* | 8/2006 | West | F21L 4/00<br>362/205 |

* cited by examiner

FIG. 5BSS

RECHARGEABLE LIGHTING DEVICES

CROSS-REFERENCE TO RELATED APPLICATIONS

This application is a continuation of U.S. application Ser. No. 15/596,986, filed May 16, 2017, which is a continuation of U.S. application Ser. No. 14/490,622, filed Sep. 18, 2014, which claimed the benefit of U.S. Provisional Application Ser. No. 61/879,596, filed Sep. 18, 2013, the contents of all of which are incorporated by reference as if fully set forth herein.

FIELD OF THE INVENTION

The field of the invention relates to rechargeable lighting devices, including rechargeable flashlights.

BACKGROUND OF THE INVENTION

Various types of lighting devices exist, including rechargeable flashlights. Rechargeable lighting devices typically include a source of energy, e.g., one or more batteries arranged in a rechargeable battery pack, contained within a housing such as a flashlight barrel. In these types of lighting devices, the positive electrode of the battery or other energy source is typically located at the forward end. However, this may not be suitable or efficient for certain configurations of lighting devices. For example, where a rechargeable flashlight includes charging contacts at or near its tail end, complications may arise if the positive electrode of the battery pack is located at the forward end. Accordingly, there is a need for a lighting device that accommodates charging contacts located at the rear of the lighting device.

Various existing lighting devices include electrical contacts that form the electrical paths between the energy source and light source. For example, spring probes may be used to provide part of the electrical paths and also provide a degree of movement to accommodate the situation where the lighting device is dropped and the battery or battery pack moves relative to the flashlight housing. However, the cost and complexity of the lighting device's design may increase where multiple spring probes or other electrical contacts are used. Accordingly, there is a need for a lighting device which uses fewer electrical contacts to simplify the design and reduce cost.

It is generally desirable for lighting devices to include brighter and longer lasting light sources. To this end, LEDs have been used as the light source for flashlights and other lighting devices for several years. However, the mounting and positioning of an LED light source within the lighting device raise issues related to heat dissipation. And while it would be preferable to use more powerful and/or larger LEDs, this would exacerbate issues related to heat dissipation as well as providing enough space to mount the LED. Accordingly, there is a need for a lighting device that may accommodate a larger and/or more powerful LED or other light source.

Various lighting devices provide multiple modes of operation such as full power beam, reduced power beam, blinking, SOS, etc. However, some of these lighting devices may be difficult to operate. Accordingly, there is a need for an improved lighting device that is easy to use.

Rechargeable lighting devices may be charged for various amounts of time thereby charging the power source a certain amount. And even after the power source is fully charged, after it is used, it will have only a certain amount of charge remaining. It would be advantageous for a user to be able to accurately determine the status of the power source or other information that may be stored in the lighting device. Accordingly, there is a need for a lighting device that may interface with a computer or other device to provide this type of information to the user.

Existing rechargeable lighting devices typically engage a charging device such as a cradle. However, the charging process may not be adequately monitored. As a consequence, the light source, e.g., an LED, may be damaged, the battery pack may lose charge if the cradle is disengaged from the wall outlet or other power source while the battery is charging, or other detrimental conditions may arise. Accordingly, there is a need for adequate monitoring of the charging process.

Existing charging devices may also require integrated charging circuits or other components that may increase cost, pose packaging issues and limit the manner in which the lighting device may be charged. Accordingly, there is a need for a charging circuit that includes fewer components and provides greater flexibility for charging parameters.

Existing rechargeable lighting devices may also include a number of components that form a power circuit to power and operate the light source, and additional components to form a charging circuit to recharge the battery or other energy source. These components may increase cost and complicate the electronics design. Accordingly, there is a need for an efficient manner in which to provide circuits that selectively operate and charge the lighting device.

Lighting devices, such as flashlights, are used in a wide variety of applications, some of which may involve harsh environments such as outdoors, law enforcement and the military. There is a need for lighting devices that are durable and dependable enough to withstand such environments.

Accordingly, there is a need for improved lighting devices, including rechargeable flashlights, that address the foregoing and other issues.

SUMMARY OF THE INVENTION

In a first aspect of the invention, a lighting device is described which includes a power source, such as a battery pack, with its positive electrode located at or near the rear end of the lighting device. In a preferred embodiment, this may allow a rechargeable lighting device to have charging contacts positioned at the rear portion of the lighting device, which may in turn allow the use of various types of charging cradles. This may also simplify the electrical circuits that operate and charge the lighting device.

In another aspect of the invention, fewer electrical contacts, e.g., spring probes, are used in the electrical paths of the lighting device. This preferably simplifies the design, improves reliability and allows the lighting device to withstand harsh environments.

In another aspect of the invention, a larger light source, such as an LED, is used to provide a brighter beam. This aspect of the invention includes innovative mounting and packaging of the light source.

In another aspect of the invention, a simplified user interface is described to select various modes of operation.

In another aspect of the invention, methods and components that may be used to remove and/or install batteries is described. This may be accomplished by, for example, a spare battery or tool.

In another aspect of the invention, a user may interface with a computer to provide battery status and other information.

In other aspects of the invention, the charging process may be monitored to efficiently charge the battery, protect components and meet efficiency regulations. Furthermore, the number of components used to charge the lighting device may be reduced or otherwise simplified by using software to control the charging process. This may be accomplished by programming a microcontroller with software that may perform certain tasks that would otherwise require additional hardware components.

In another aspect of the invention, electrical circuits to operate and charge the lighting device are described. To this end, an efficient means to shift between the operational and charging circuits is described.

Another aspect of the current invention regards the especially rugged nature of certain embodiments. For example, certain embodiments may have a housing of increased thickness to protect the interior components from harsh environments. As another example, certain embodiments may have rugged internal components and circuitry that may withstand significant jolts, such as recoil when the lighting device is mounted on a firearm.

The current invention addresses the foregoing and other issues as described herein.

BRIEF DESCRIPTION OF THE DRAWINGS

FIG. 2' is a cross-sectional side view of the rechargeable flashlight of FIG. 2 taken along section line A'-A'.

FIG. 4' is an enlarged cross-sectional view of the rear or tail cap section of the flashlight of FIG. 1' taken along section line A'-A'.

FIG. 5BT is a top view of a lighting module.

FIG. 5BS is a side view of a lighting module.

FIG. 5BSS is a side view of a lighting module.

FIG. 5BB is a cross-sectional view of a lighting module taken along section line A-A.

FIG. 5EE is a rear view of a circuit board for the tail cap assembly.

DETAILED DESCRIPTION OF THE PREFERRED EMBODIMENTS

Figure 1:
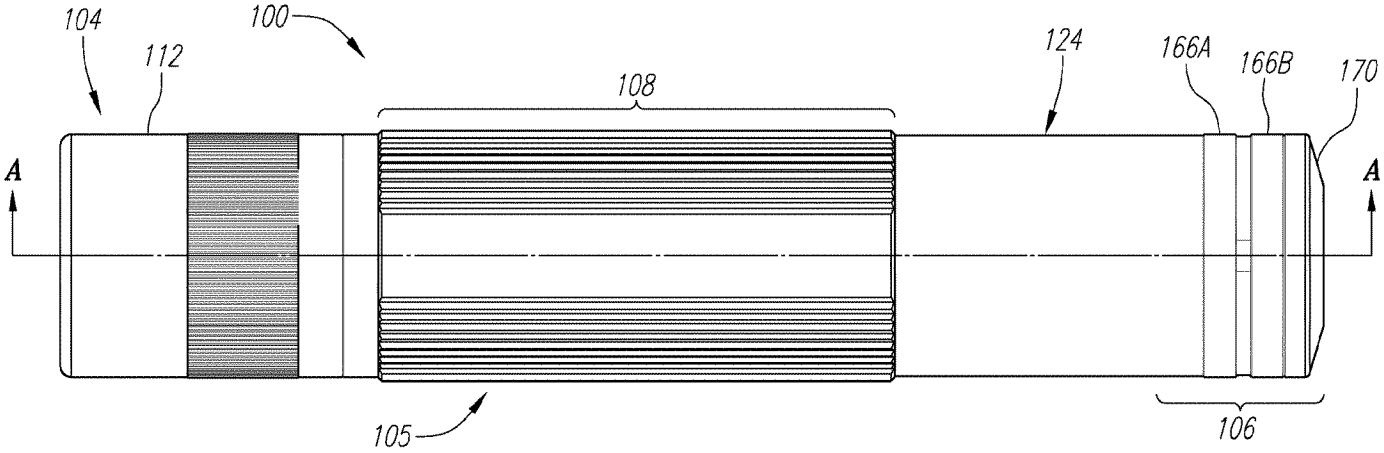
FIG. 1 is a side view of a rechargeable flashlight.

The current invention is now described with reference to the figures. The same or similar components appearing in more than one figure may bear the same reference numeral. To this end, reference is made to flashlight 100 and flashlight 100'. Where components thereof are not specifically discussed as operating differently, such components may be regarded as operating similarly. It should be noted that the scope of the current invention is not limited to the examples specifically shown and discussed herein, but also includes alternatives and equivalents thereto.

An embodiment of a lighting device of the current invention, such as rechargeable flashlight 100, is shown in the figures. Flashlight 100 incorporates a number of inventive aspects and features, and while these aspects and features have been incorporated into flashlight 100 in various combinations, the scope of the present invention is not restricted to flashlight 100 as specifically described herein. Rather, the present invention is directed to each of the inventive features of flashlight 100 described below both individually as well as in various combinations. Further, as will become apparent to those skilled in the art after reviewing the present disclosure, one or more aspects of the present invention may also be incorporated into other portable lighting devices, including, for example, head lamps and lanterns.

Figure 2:
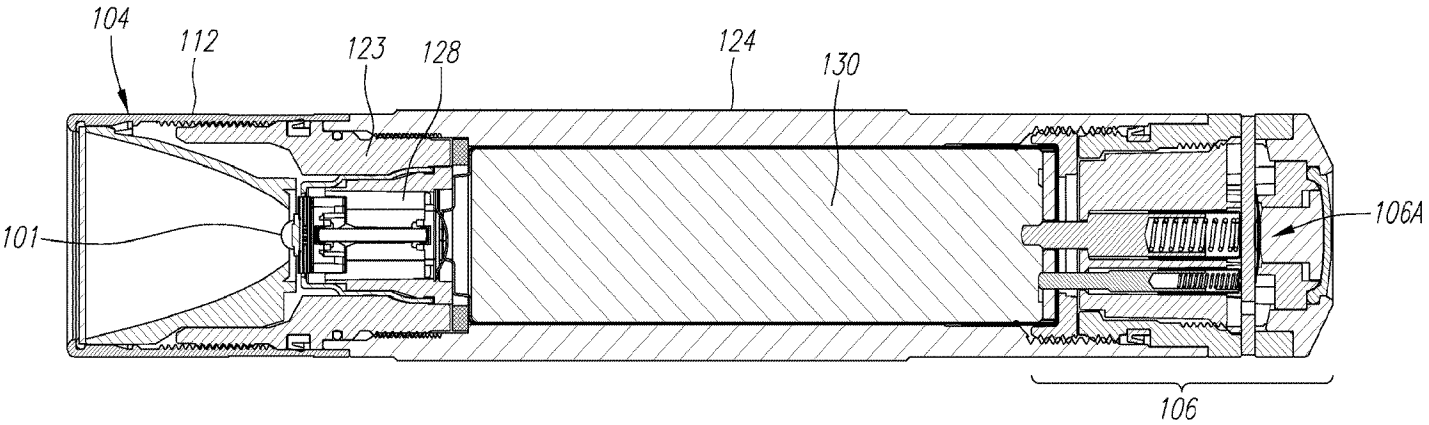
FIG. 2 is a cross-sectional side view of the rechargeable flashlight of FIG. 1 taken along section line A-A.
Figure 1:
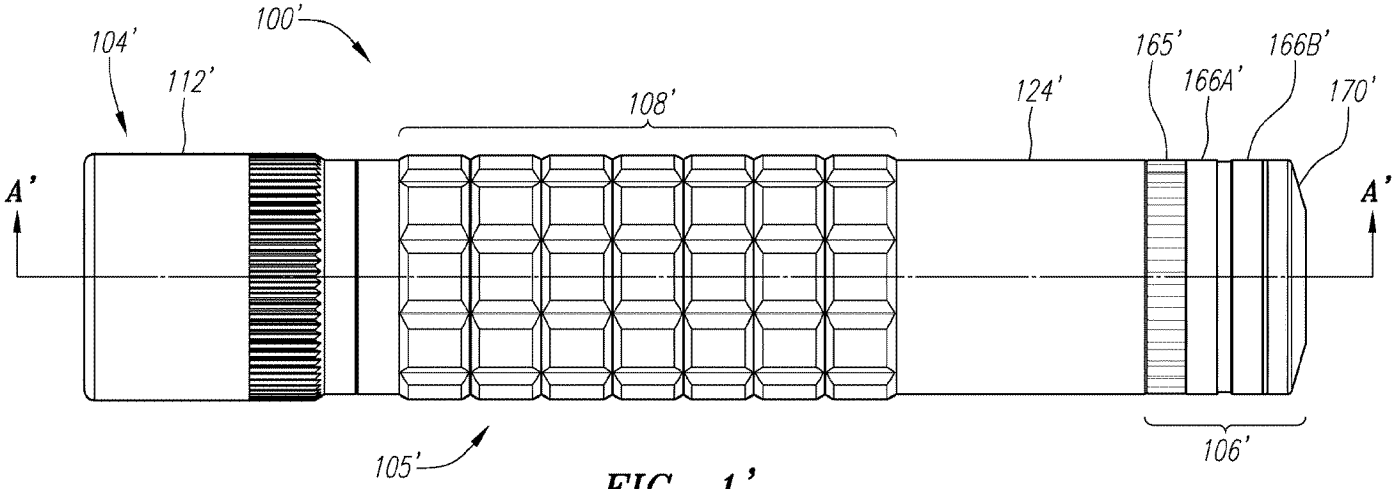
Figure 2:
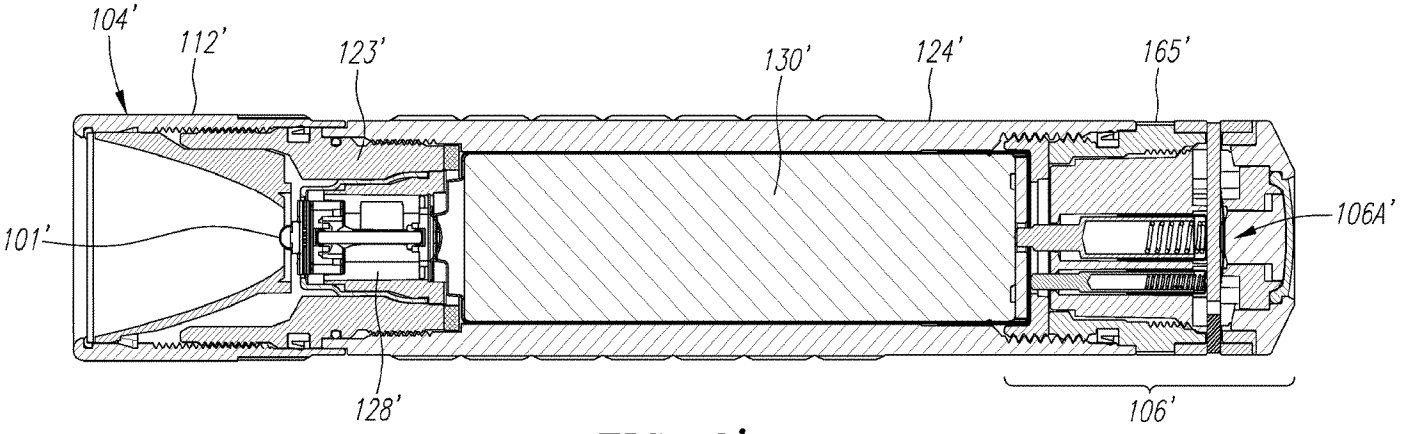
Figure 5A:
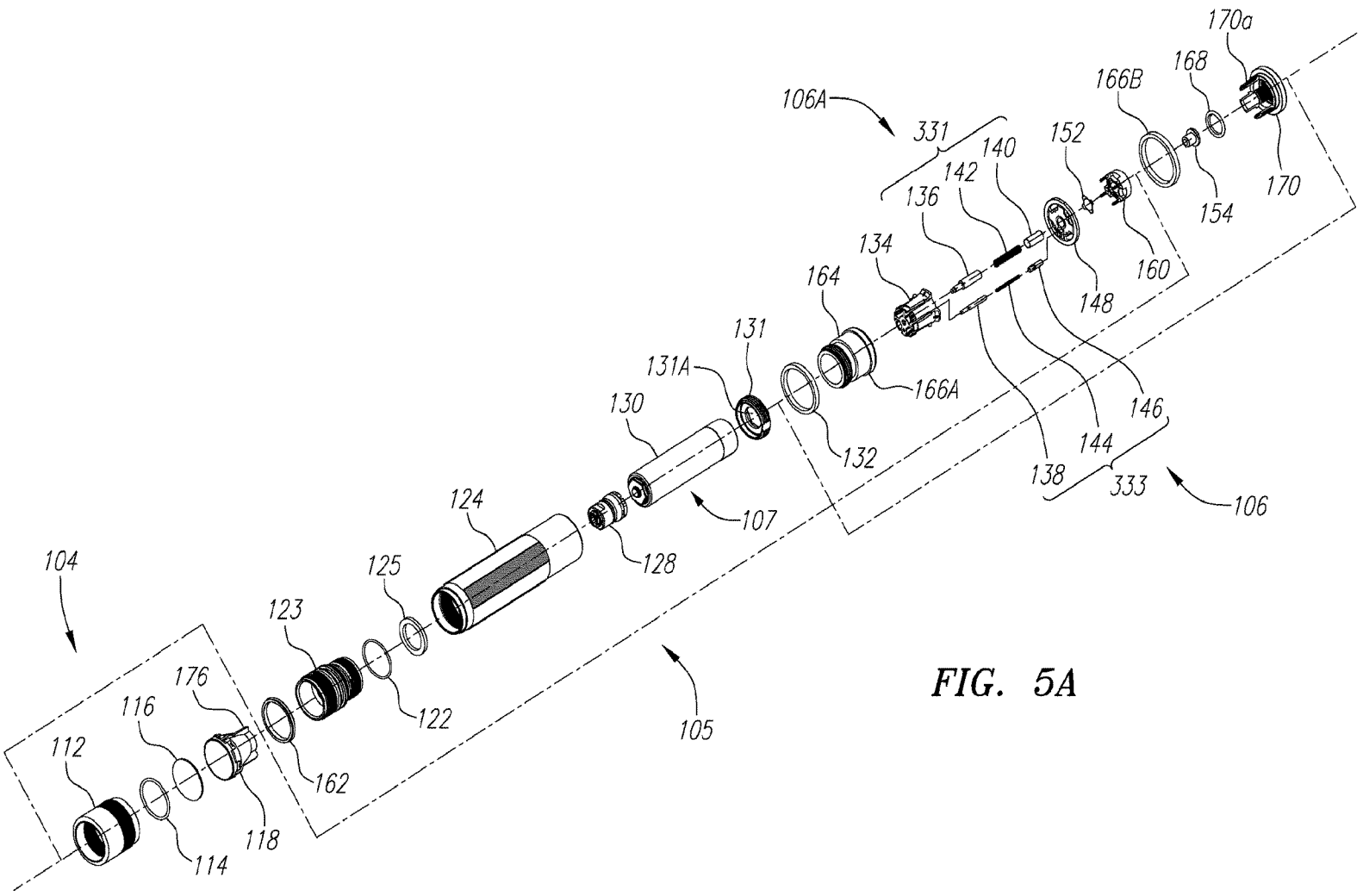
FIG. 5A is an exploded view of the rechargeable flashlight of FIG. 1.
Figure 5A:
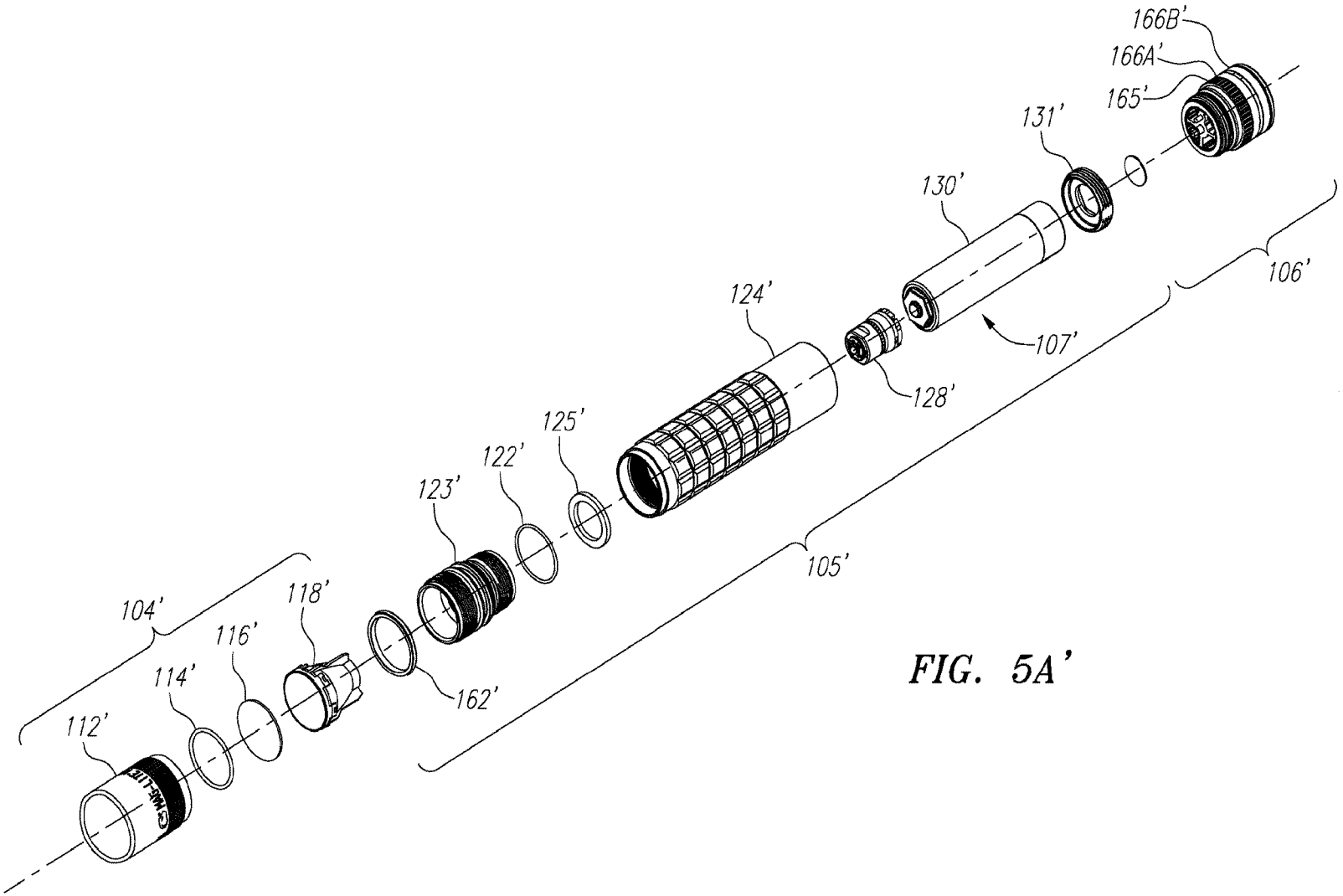

As shown in FIGS. 1, 2 and 5A, flashlight 100 may generally include head assembly 104, barrel assembly 105 and tail cap assembly 106. Barrel assembly 105 may include battery assembly 107 as well as lighting module 128. Tail cap assembly 106 may include switch assembly 106A. As shown in FIG. 1, flashlight 100 may include front and rear charging rings 166A, 166B on its exterior at or near its tail end. Flashlight 100 may also include knurling or other decorative pattern 108, such as that shown in U.S. application Ser. No. 13/216,092, filed Aug. 23, 2011, and U.S. Design Application Ser. No. 29/404,369, filed Oct. 19, 2011, the entireties of which are incorporated by reference as if fully set forth herein.

Similar views of an alternate embodiment of flashlight 100' are shown in FIGS. 1', 2' and 5A' where the same or similar components bear similar reference numerals with a prime designation, e.g., head assembly 104'. In this embodiment, decorative pattern 108' on barrel assembly 105' may reflect a faceted appearance. Tail cap assembly 106' may also include a knurled section 165'.

The above-referenced assemblies are now generally described. As shown in FIG. 5A, barrel assembly 105 may include lip seal 162, front barrel 123, front barrel o-ring 122, washer 125, rear barrel 124, lighting module 128, battery pack 130 and battery nut 131. Head assembly 104 may be located at the forward end of front barrel 123, and may include combined head and face cap 112, o-ring 114, lens 116 and reflector 118. Tail cap assembly 106 may be located at the rear end of rear barrel 124, and may include switch assembly 106A, charging rings 166A, 166B and other components which provide for the operation and charging of flashlight 100 as described in more detail later.

An alternative embodiment is shown in FIG. 5A' where the same or similar components bear similar reference numerals with a prime designation. Certain components in FIG. 5A' may differ from those as shown in FIG. 5A as described later.

Barrel assembly 105 is now further described with reference to FIGS. 1-4 and 5A. Rear barrel 124 may be a hollow, tubular structure suitable for housing a portable source of power, such as, for example, rechargeable battery pack 130. However, barrel 124 may comprise cross-sectional shapes other than a tube and may accommodate batteries having different shapes.

Rear barrel 124 may be sized to accommodate a battery pack 130, which may contain a Lithium Iron Phosphate cell ($LiFePO_4$). In other embodiments, however, one or more alkaline dry cell or other types of rechargeable batteries of various sizes may be used. Further, if a plurality of batteries are employed, depending on the implementation, they may be connected electrically in parallel or series. Other suitable portable power sources, including, for example, high capacity storage capacitors may also be used.

Front barrel 123 and rear barrel 124 may preferably comprise aluminum or other suitable material. In a preferred embodiment where barrels 123, 124 may form part of the electrical path of flashlight 100, it is preferred that they comprise a conductive material. In other embodiments, barrels 123, 124 may not comprise a conductive material but may include a conductive member to form part of the electrical path. In view of the foregoing, front barrel 123 and rear barrel 124 may be made out of metal or non-metal (e.g., plastic) materials.

In addition, rear barrel 124 may include a knurled surface 108 or other decorative pattern along a portion of its length. In the present embodiment, surface 108 may be provided by broaching, or alternatively, may be formed from machined knurling or other process. Any desired decorative pattern may be used for textured surface 108, including those in U.S. application Ser. No. 13/216,092, filed Aug. 23, 2011, and U.S. Design Application Ser. No. 29/404,369, filed Oct. 19, 2011, the entireties of which are incorporated by reference as if fully set forth herein. As shown in FIG. 1', decorative pattern 108' may reflect a faceted appearance.

Figure 3:
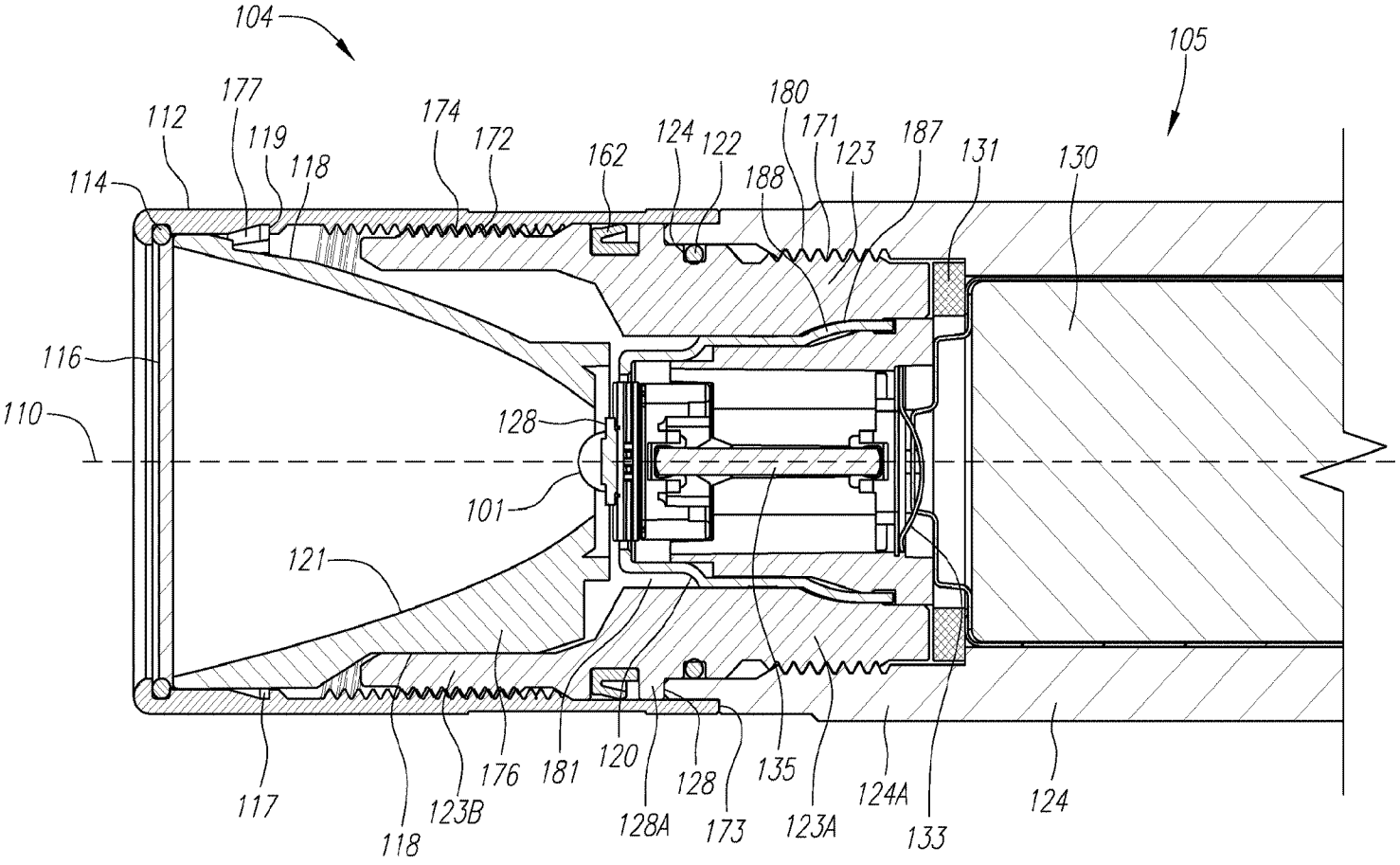
FIG. 3 is an enlarged cross-sectional view of the forward or head section of the flashlight of FIG. 1 taken along section line A-A.

As shown in FIGS. 2 and 3, the rear portion 123A of front barrel 123 may engage and fit inside the forward portion 124A of rear barrel 124. To this end, rear barrel 124 may include internal threads 180 on the interior of its front portion 124A, and front barrel 123 may include external threads 171 on the exterior of its rear portion 123A. Threads 171, 180 may engage each other so that front barrel 123 may be screwed into front portion of rear barrel 124.

The front portion 124A of rear barrel 124 may also include front shoulder 128 to engage flange 128A of front barrel 123. The rear edge of front barrel 123 may also engage battery washer 131. With the engagement between threads 171, 180, and between shoulder 128 and flange 128A, front barrel 123 and rear barrel 124 may be snugly secured together to prevent dirt or other debris from entering into flashlight 100. Front barrel 123 may also include a groove 124 that extends about its circumference. Groove 124 may accommodate o-ring 122 which may further help to seal the engagement between barrels 123, 124. While the above embodiment depicts barrels 123, 124 being secured with threads 171, 180, other attachment means may be used such as press fit, clips, screws, welding or other means.

An alternate embodiment of barrel assembly 105' is shown in FIGS. 1', 2' and 4' where the same or similar components are shown with the same reference numerals with a prime designation. Aspects of forward portion of barrel section 105' may be the same or similar as shown in FIG. 3. In this embodiment, the overall length of barrel section 105' may be shortened to accommodate a longer tail cap section 106' that may itself be longer so as to include knurling 165'. For example, rear barrel 123' may be shorter than rear barrel 123. As such, the location of charging rings 166A'-166B' may remain the same so as to engage a charging apparatus.

Head assembly 104, and its engagement with barrel assembly 105, is now further described with reference to FIGS. 2, 3 and 5A. As mentioned above, head assembly 104 may include combined head and face cap 112, o-ring 114, lens 116, and reflector 118.

As shown, front barrel forward portion 123B may have an outer diameter smaller than the inner diameter of the rear portion of combined head and face cap 112. In this manner, front barrel forward portion 123B may fit inside the rear portion of the combined head and face cap 112. Combined head and face cap 112 may include interior threads 172 that engage exterior threads on front barrel forward portion 123B to connect head assembly 104 and barrel assembly 105.

One-way valve 162 may be provided at the interface between front barrel 123 and head assembly 104 as shown in FIG. 3 to provide a watertight seal while simultaneously allowing pressure within flashlight 100 to vent to atmosphere. However, other forms of sealing elements may be used. Lip seal 162 may preferably comprise a non-conductive material such as rubber.

As shown in FIG. 3, rear barrel front portion 124A may also include a front annular shoulder notch 173 that may act as a stop for the rear portion of the combined head and face cap 112 when head assembly 104 engages barrel assembly 105. It is preferred that combined head and face cap 112 engages front barrel 123 and rear barrel 124 to prevent dirt or other debris from entering flashlight 100. It should be noted that while the above depicts head 112 and front barrel 123 engaging each other with threads 172, 174, other attachment means may be used such as clips, screws, welding or other means.

As shown in FIG. 2, the outer cylindrical surface of the head assembly 104 may be flush with the outer cylindrical surface of rear barrel 124 when head assembly 104 is secured onto front barrel 123, and front barrel 123 is secured into rear barrel 124 as described above. In this configuration, the combined assemblies may form a substantially uniform cylinder. Alternatively, the surfaces of head assembly 104, front barrel 123 and rear barrel 124 need not be flush and/or may form other shapes that may be uniform or non-uniform.

Combined head and face cap 112 be made from anodized aluminum, but other suitable materials may be used. Head 112 may house components, including, for example, lens 116 and reflector 118. Reflector 118 and lens 116 may be mounted to the inner diameter of combined head and face cap 112. Reflector 118 may include spring clips 177 that may extend from its front end so that reflector 118 may snap into a corresponding annular recess 117 formed near the forward end of the inner portion of combined head and face cap 112. An annular shoulder notch 119 may be provided at the aft end of annular recess 117 to secure reflector 118 to the combined head and face cap 112 once spring clips 177 expand into annular recess 117. Lens 116 may be interposed between a forward facing flange of reflector 118 and an inwardly turned lip of the combined head and face cap 112. In this manner, reflector 118 and lens 116 may be locked within the combined head and face cap 112.

Reflector 118 may include fins 176 located about its outer perimeter. Fins 176 may provide structural integrity to reflector 118, and may also help properly align reflector 118 within the internal surface of the front barrel forward portion 123B so that its reflective surface 121 properly engages the light from light source 101.

A sealing element, such as an o-ring 114, may be located at the interface between combined head and face cap 112 and lens 116 to provide a watertight seal. Other water resistant means, such as a one-way valve, may also be used. O-ring 114 may comprise rubber or other suitable material.

As best seen in FIGS. 3 and 5A, the reflective profile 121 of the reflector 118 may preferably be a segment of a computer-generated optimized parabola that may be metallized to ensure high precision optics. The shape, dimensions and profile of reflector 118 are further described in U.S. application Ser. No. 10/922,714, filed Aug. 20, 2004, and Ser. No. 12/657,290, filed Jan. 15, 2010, the disclosures of which are incorporated by reference as if fully set forth herein. Reflector 118 may preferably comprise an injection molded plastic, though other suitable materials may be used.

Still referring to FIG. 3, although the embodiment disclosed herein illustrates a substantially planar lens 116, the flashlight 100 may instead include a lens that has curved surfaces to further improve the optical performance of the flashlight 100. For example, the lens may include a biconvex profile or a plano-convex profile in the whole or part of the lens surface.

Head assembly 104', and its engagement with barrel assembly 105', in the embodiment of flashlight 100', are shown in FIGS. 2' and 5A', where the same or similar components are shown with the same reference numerals with a prime designation. Aspects of flashlight 100' may be the same or similar as shown in FIG. 3.

Referring now to FIGS. 2, 3, 5A, 5B and 5BB, lighting module 128 is now further described. Lighting module 128 may be mounted within front barrel 123. For example, lighting module 128 may be mounted within front barrel rear portion 123A so that light source 101 may be disposed at or near the aft end of reflector 118. Module 128 may have a principal axis 110 of projection which may coincide with the reflector axis and/or the longitudinal axis of flashlight 100. The focus of light emitted from lamp module 128 may be adjusted by twisting head assembly 104 relative to front barrel 123, which may be provided by mating threads 172, 174.

Lighting module 128 has been described in U.S. application Ser. Nos. 11/227,768, filed Sep. 15, 2005, 12/188,201, filed Aug. 7, 2008, and 12/657,290, filed Jan. 15, 2010, and their disclosures are incorporated by reference as if fully set forth herein. To this end, the structure of previously described lighting modules in the above-referenced applications may be the same, or similar, to lighting module 128 used in flashlight 100 of the current invention. However, as discussed below, the polarity and electrical paths in lighting module 128 may be reversed so that the positive (+) path delivering power in the prior lighting modules may now form a ground (−) path, and vice versa.

The light source 101 used in lighting module 128 may be any suitable device that generates light. Light source 101 is preferably an LED, though other light sources such as an incandescent lamp or an arc lamp may be used. LED light source 101 may substantially radiate light at a spherical angle of less than 180°. In other embodiments, LEDs with other angles of radiation may be used, including LEDs that radiate at an angle greater than 180°.

Figure 5B:
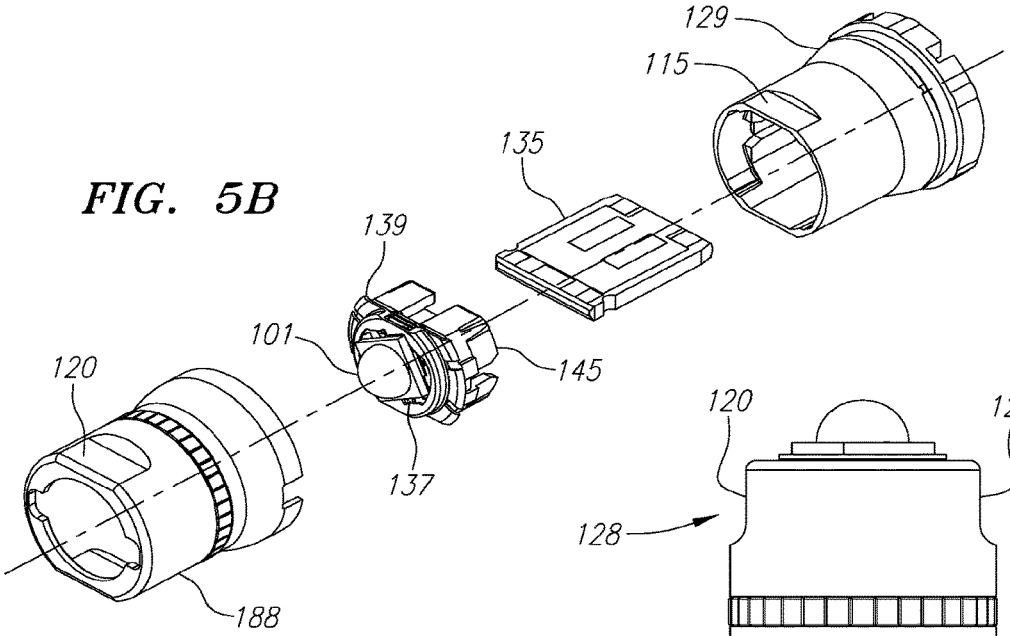
FIG. 5B is an exploded view of a lighting module.
Figure 5B:
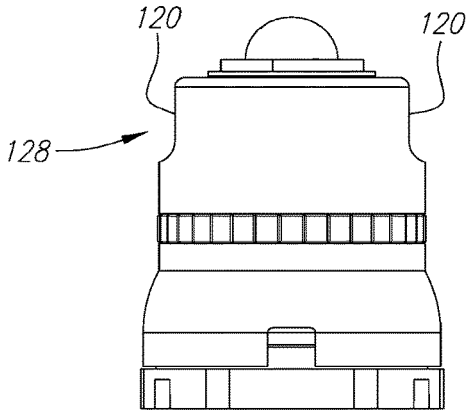
Figure 5B:
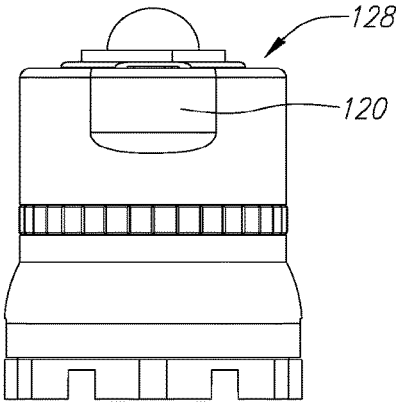
Figure 5B:
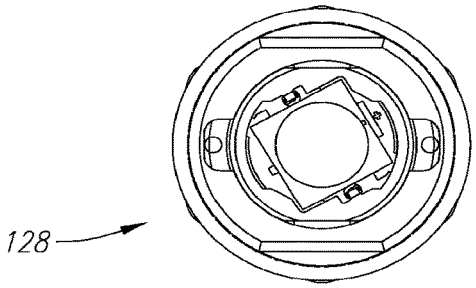
Figure 5B:
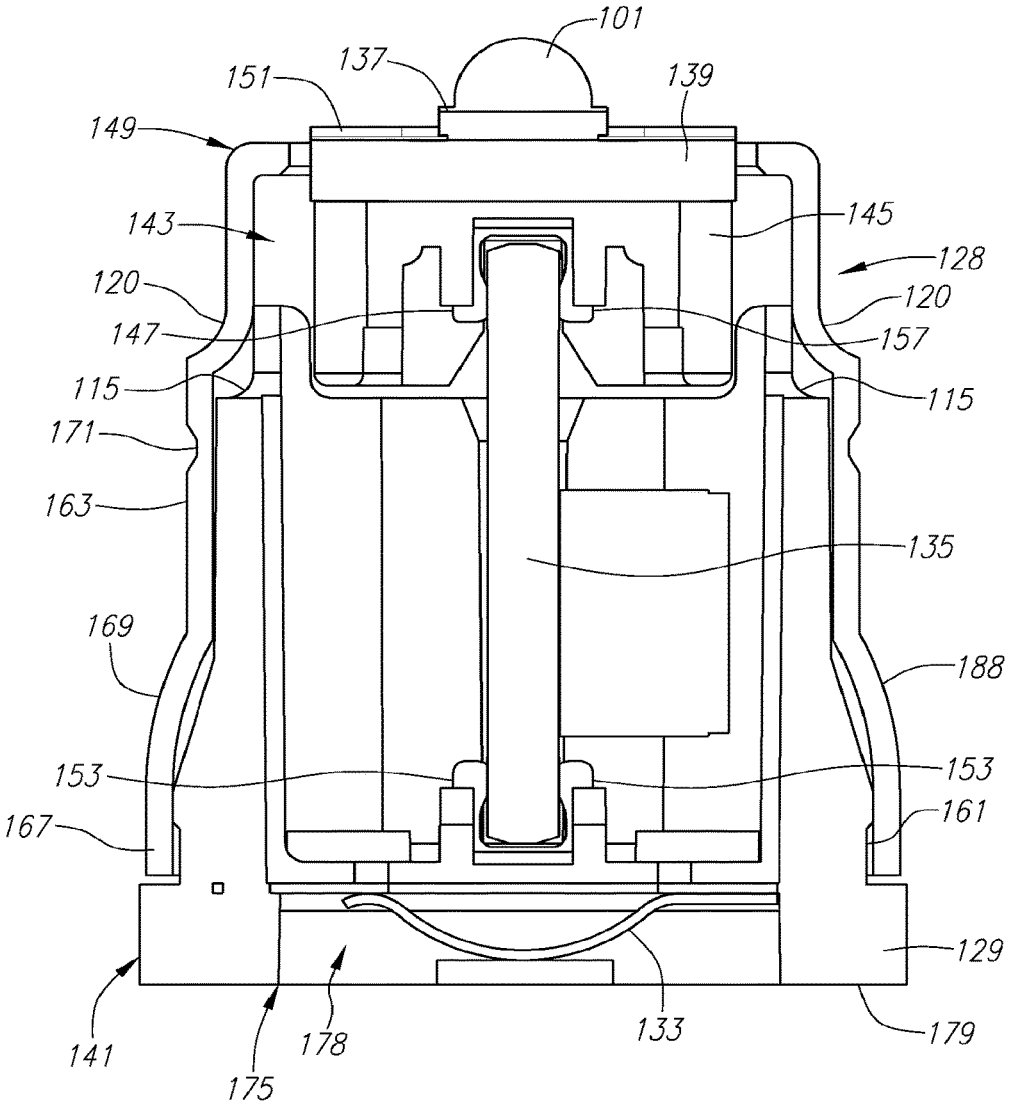

As shown in FIG. 5B, module 128 may generally include outer heat sink housing 188 having notches 120. LED 137 may include light source 101 and may be mounted on printed circuit board 139 which may in turn be mounted on upper insulator 145. A second printed circuit board 135 may be included and inserted into lower insulator 129 that itself may contain a potting material such as resin. Insulator 129 may have notches 115 that correspond to notches 120 when lower insulator 129 is inserted into heat sink housing 188.

LED 139 and light source 101 may be larger than other LEDs commonly used. To accommodate this size, LED 139 may be rotated so that it is mounted diagonally. This type of mounting is described in U.S. application Ser. No. 61/858,818, filed Jul. 26, 2013, the contents of which are incorporated by reference as if fully set forth herein.

Mounting LED 139 in a rotated manner may provide for the reversed polarity through lighting module 128 as mentioned above. That is, by rotating LED 139, its leads contact leads in lighting module 128 that are different than the leads they would contact if LED 139 were not rotated. To this end, LED 139 may include a first, negative electrode in electrical communication with a compressible negative contact 133 (see FIGS. 3 and 5BB) via circuit board 135. LED 139 may also include a second, positive electrode in electrical communication with the heat sink housing 188. Details of the electrical paths will be described in later sections.

FIG. 5BB is a cross-sectional view of lighting or LED module 128. Module 128 may include LED 137 with light source 101, a first circuit board 139, a lower assembly 141 formed by compressible negative-contact 133 and a lower insulator 129, a second circuit board 135, an upper assembly 143 formed by an upper insulator 145 and an upper negative contact 147 and an upper positive contact 155 (see FIG. 3), and a heat sink 149 formed by the outer heat sink housing 188 and a contact ring 151, which may preferably be made out of metal.

Referring to FIGS. 3 and 5BB, compressible negative contact 133 may preferably include two clips 153 for making electrical contact with second circuit board 135, one of the clips 153 being displaced before the page in the cross-sectional view provided in FIG. 5BB. The second circuit board 135 may be in electrical contact with upper negative or ground contact 147 and an upper positive contact 155 (see FIG. 3), which may be preferably solder connected to the bottom side of the first circuit board 139. The upper negative contact 147 may preferably include two clips 157, one of which may be displaced before the page in the view provided in FIG. 5BB. The upper positive contact may also include two clips 157 for making electrical contact with the second circuit board 135, one of which may be displaced behind the clip 157 of the upper negative contact shown in FIG. 5BB and one of which may be displaced before the page in the view provided in FIG. 5BB. The upper negative contact 147 may be in electrical communication with the negative electrode of LED 137 via first circuit board 139 and the upper positive contact may be in electrical communication with the heat sink 149 via the first circuit board 139.

LED 137 and the heat sink 149 may be affixed to the first circuit board 139, preferably via a solder connection. The first circuit board 139, which preferably may be a metal clad circuit board having a plurality of thermally conductive layers connected by thermal vias, may promote the rapid and efficient transfer of heat from the LED 137 to the heat sink 149.

LED 137 may be any light emitting diode that may be soldered or otherwise attached to a printed circuit board. Preferably, LED 137 may be soldered to the first circuit board 139 using a screen applied solder paste and a reflow oven. More preferably, the LED 137 may be a Cree XM-L2 LED.

The second circuit board 135 may comprise a pass through board, though it may also contain a buck/boost regulating circuit to enhance LED brightness. More specifically, the second circuit board 135 may include a buck regulating circuit to reduce driving voltage to the lamp module 128, because the voltage delivered by assembled circuit board 240 may be much higher than the operating voltage of LED 137. In other implementations, however, the second circuit board 135 may include a boost regulating circuit for providing an adequate voltage to LED 137 when the driving voltage to the lamp module 128 is lower than the operating voltage of one or more LEDs 137 that are to be driven. In other words, the second circuit board 135 may provide a buck or a boost operation depending on the needs of the load and the battery voltage. If the battery voltage is high, the buck operation may be performed. On the other hand, if the battery voltage is low, the boost operation may be performed. In some implementations, a buck operation may be performed initially, while a boost operation may be provided after the voltage of the batteries may drop below a certain level.

The lower assembly 141 may preferably be formed by co-molding compressible negative contact 133 and a lower insulator 129 together. Likewise, upper assembly 143 may preferably be formed by co-molding upper insulator 145 and an upper negative contact 147 and an upper positive contact 155 together. Thus, the upper and lower insulators 145, 129 may preferably be formed from an injection moldable plastic with suitable structural and thermal qualities for the application.

The upper positive and negative contacts of the upper assembly 143 may be soldered to the bottom of the first circuit board 139, the front side of which may in turn be soldered to contact ring 151, which may be press fit and/or soldered to heat sink housing 188. Thus, the upper assembly 143 may be firmly held within heat sink housing 188 in the present embodiment. Further, the circumference of heat sink housing 188 may be crimped into an annular recess 161 of the lower insulator 129. The crimping of heat sink housing 188 into annular recess 161 may hold lower insulator 129 and hence the lower assembly 141 within heat sink housing 188.

In addition, as shown in FIGS. 3, 5B and 5BB, lower insulator 129 may also include a front shelf 115 that may generally align and engage with shoulder 120 of heat sink 188 when lower insulator 129 is configured inside heat sink 188 as described above. The general engagement of front shelf 115 with shoulder 120 may limit any axial movement of lower insulator 129 with respect to heat sink 188.

When flashlight 100 is turned ON, heat sink housing 188 may thermally and electrically couple the light source 101 and front barrel 123. To this end, heat sink housing 188 may electrically couple the positive electrical path of front barrel 123 to second circuit board 135 to provide power to the positive contact on LED 139. Heat sink housing 188 may therefore act as the positive contact for the lamp module 128. Further, by arranging heat sink housing 188 as shown in FIG. 3 so that it is in good thermal contact with front barrel 123, which in turn, as more fully explained below, may be in good thermal contact with rear barrel 124, when the flashlight 100 may be ON, heat generated by light source 101 may be efficiently absorbed and/or dissipated by the first circuit board 139 to contact ring 151, the heat sink housing 188, front barrel 123, and rear barrel 124. Thus flashlight 100 may be able to effectively protect the light source 101 from being damaged due to heat. Preferably, heat sink housing 188 may be made from a good electrical and thermal conductor, such as aluminum.

Heat sink housing 188 may be formed so that it flares in a region 169 toward the back or bottom of the lamp module 128 from a first region 163 having a first diameter to a second region 167 having a second, larger diameter. The diameter of the first region 163 may be sized so that it may closely fit within front barrel 123 while at the same time, making thermal contact therewith. An inner aft facing surface of front barrel 123 may form a contact surface 187. The outer diameter of the lower insulator 129 and heat sink housing 188 may be sized so that there is little or no play in the radial direction between the inner wall of the forward barrel 123 and the lower insulator 129 and heat sink housing 188. In this way, when lamp module 128 may be positioned within front barrel 123 so that flared region 169 of heat sink housing 188 may come into contact with the contact surface 187 of the front barrel 123, the heat sink housing 188 may be in thermal and electrical contact with front barrel 123 in the first, second and flared regions 163, 167, 169, respectively.

As shown in FIG. 3 and FIG. 3A, region 163 of the heat sink housing 188 may be sized so that once disposed in the front barrel 123, lamp module 128 may fit snugly within front barrel 123. In addition, the outer surface of heat sink housing 188 may also include front shoulders 120 in the region 163 of the first diameter. In addition, front barrel 123 may include locking tabs 181 that may be positioned on its inner surface as shown in FIG. 3. Front shoulders 120 may be positioned to receive locking tabs 181 of front barrel 123 when the lamp module 128 may be mounted within the forward end of front barrel 123. With front shoulders 120 engaged with locking tabs 181, heat sink housing 188 may be held securely within front barrel 123. While FIG. 3A shows front shoulders 120 and locking tabs 181 generally located on the top and bottom of heat sink 188 and front barrel 123 respectively, front shoulders 120 and locking tabs 181 may be located in other areas of heat sink 188 and front barrel 123.

The flared region 169 of heat sink housing 188 may preferably be shaped to mate with contact surface 187 of front barrel 123 along as much surface area as possible to facilitate electrical and thermal communication between the lamp module 128 and the front barrel 123.

Figure 6:
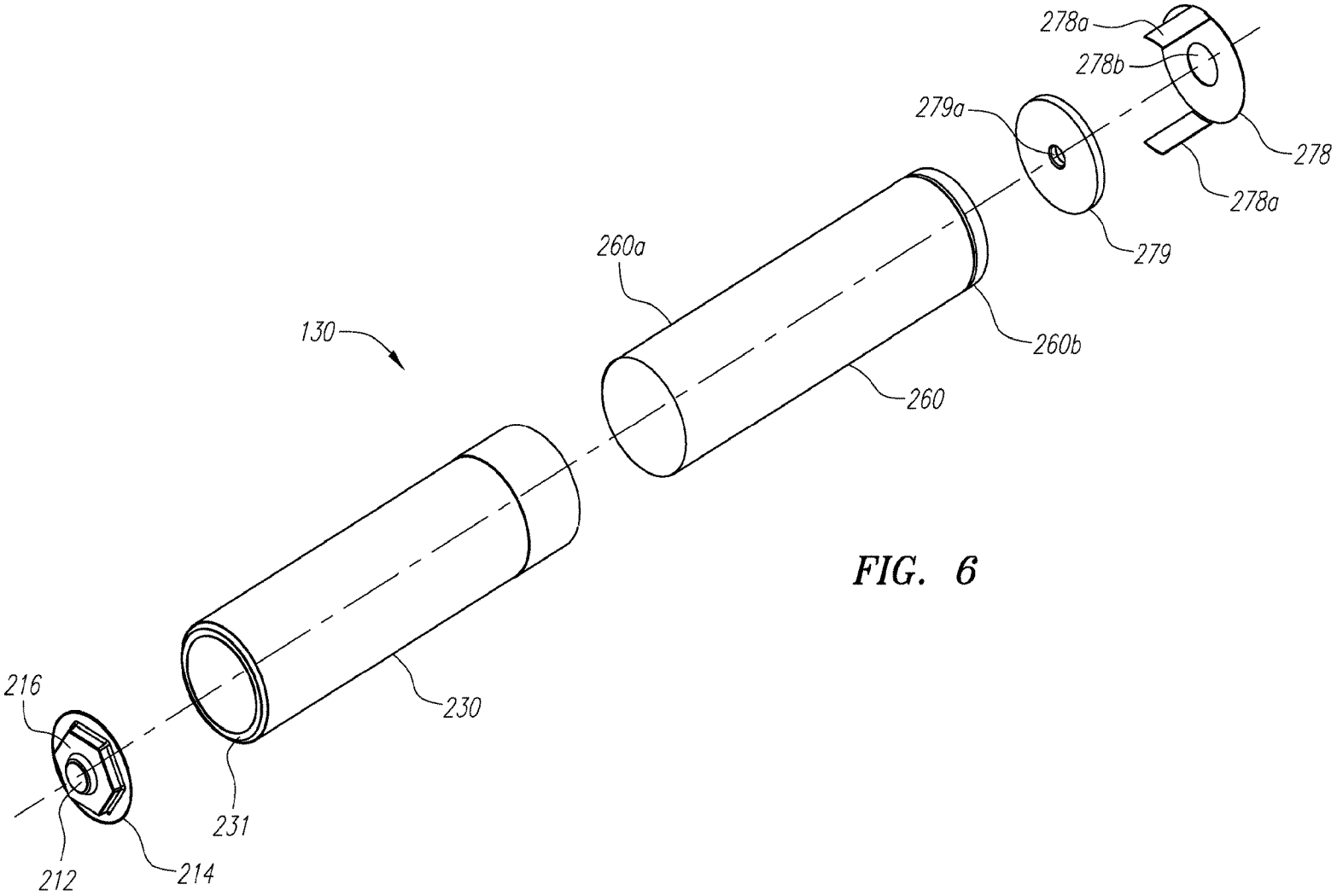
FIG. 6 is an exploded view of a rechargeable battery pack.

Lower insulator 129 may include at its back face 175 a recess 178, which may be surrounded by an annular shoulder 179 so that recess 178 may be centrally located. The recess 178 may be dimensioned to be deeper than the height of the negative electrode 214 of battery pack 130 (as shown in FIG. 6). However, as shown in FIGS. 2 and 3, when the battery pack 130 may be urged forward against the back face 175 of the lower insulator 129, so the negative contact 212 of battery pack 130 may engage compressible negative contact 133.

In this way, the lamp module 128 may provide a simple configuration that enhances the electrical coupling between components even when the flashlight is jarred or dropped, which may cause the battery pack 130 to suddenly displace axially within rear barrel 124. This arrangement may also help maintain electrical contact when flashlight 100 is used in harsh environments, such as a gunsight that experiences recoil forces. Further, because the compressible negative contact 133 may absorb impact stresses due to, for example, mishandling, and recess 178 may be deeper than the negative electrode 214 of battery pack 130, the battery pack 130 and its electronics, which are discussed below, may be protected from physical damage during use of flashlight 100.

Also, because compressible negative contact 133 may be disposed forward of the shoulder 179 of back face 175, if battery pack 130 is inserted backwards into rear barrel 124, so that its positive electrode is facing forward, no electrical coupling with compressible negative contact 133 may be formed. Accordingly, the configuration of the lamp module 128 and its arrangement within rear barrel 124 may help to protect the flashlight's electronics from being affected or damaged by reverse current flow.

Referring to FIG. 3, front barrel rear portion 123A may form a large heat sink because its mass may be larger than that of LED module 128. As such, heat may be quickly drawn away from heat sink 188 and transferred to rear barrel 124 via the threaded engagement between barrels 123, 124.

While front barrel 126, lamp module 128, and head assembly 104 may not form part of a mechanical switch for flashlight 100 in the present embodiment, in other embodiments they could as described, for example, in U.S. patent application Ser. No. 12/353,396, filed Jan. 14, 2009, by Stacey West, the contents of which are hereby incorporated by reference as if fully set forth herein.

LED Module 128' in the embodiment of flashlight 100' is shown in FIGS. 2' and 5A' beyond appearing as LED Module 128 in the other figures.

Tail Cap and Switch Assembly is now further described with reference to FIGS. 4, 5A, 5C and 5D. As shown in FIG. 5A, switch and tail cap assembly 106 may include tail cap lip seal 132, barrel section tail cap 164 (which includes forward charging ring 166A), lower switch housing 134, positive plunger 136, positive plunger spring 142, positive plunger barrel 140, ground plunger 138, ground plunger spring 144, ground plunger barrel 146, PCB 148, snap dome 152, upper switch housing 160, rear charging ring 166B, actuator 154, switch port seal 168, and button section tail cap 170, among other components.

Figure 5C:
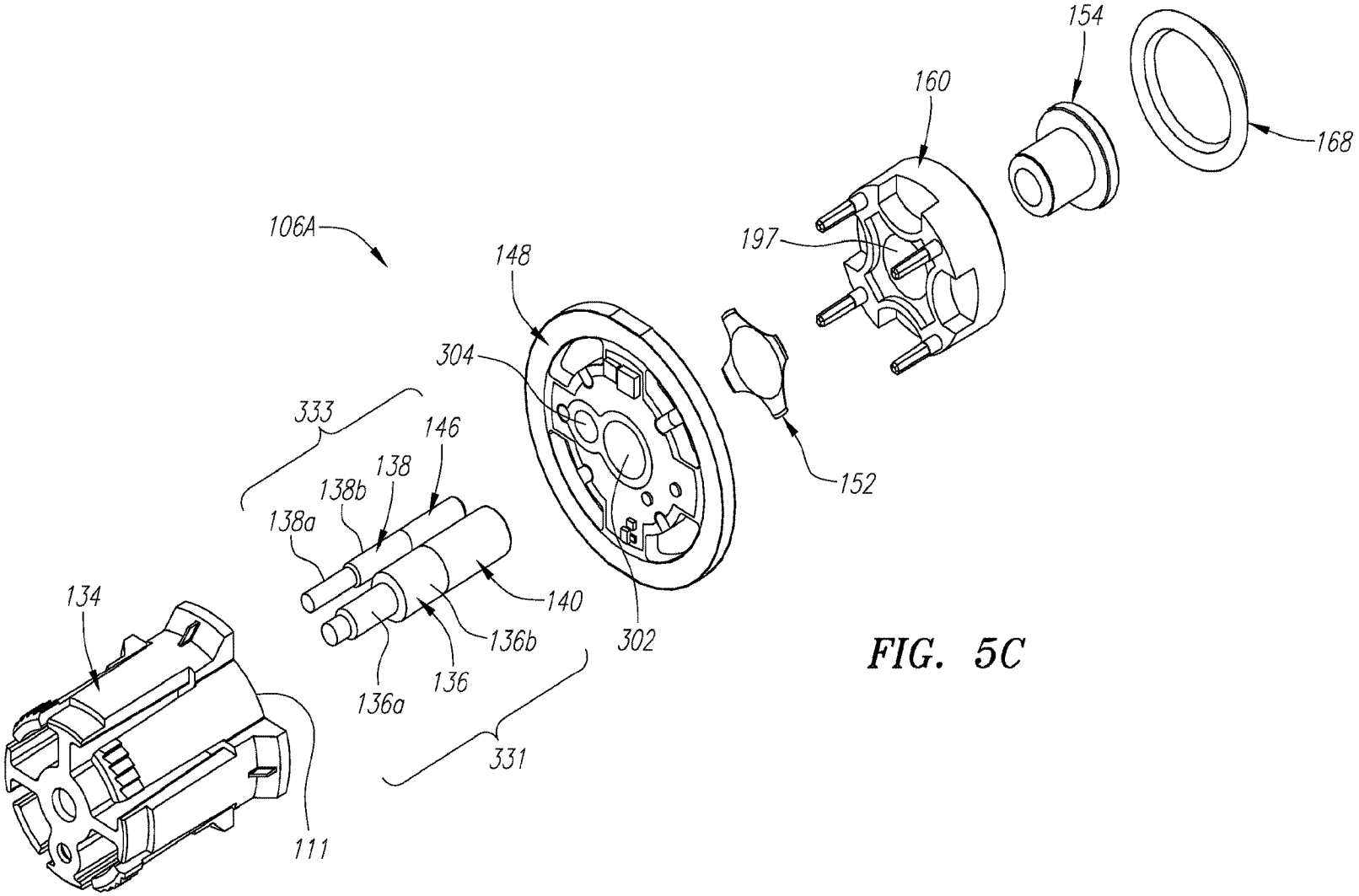
FIG. 5C is an exploded view of a switch assembly.
Figure 5C:
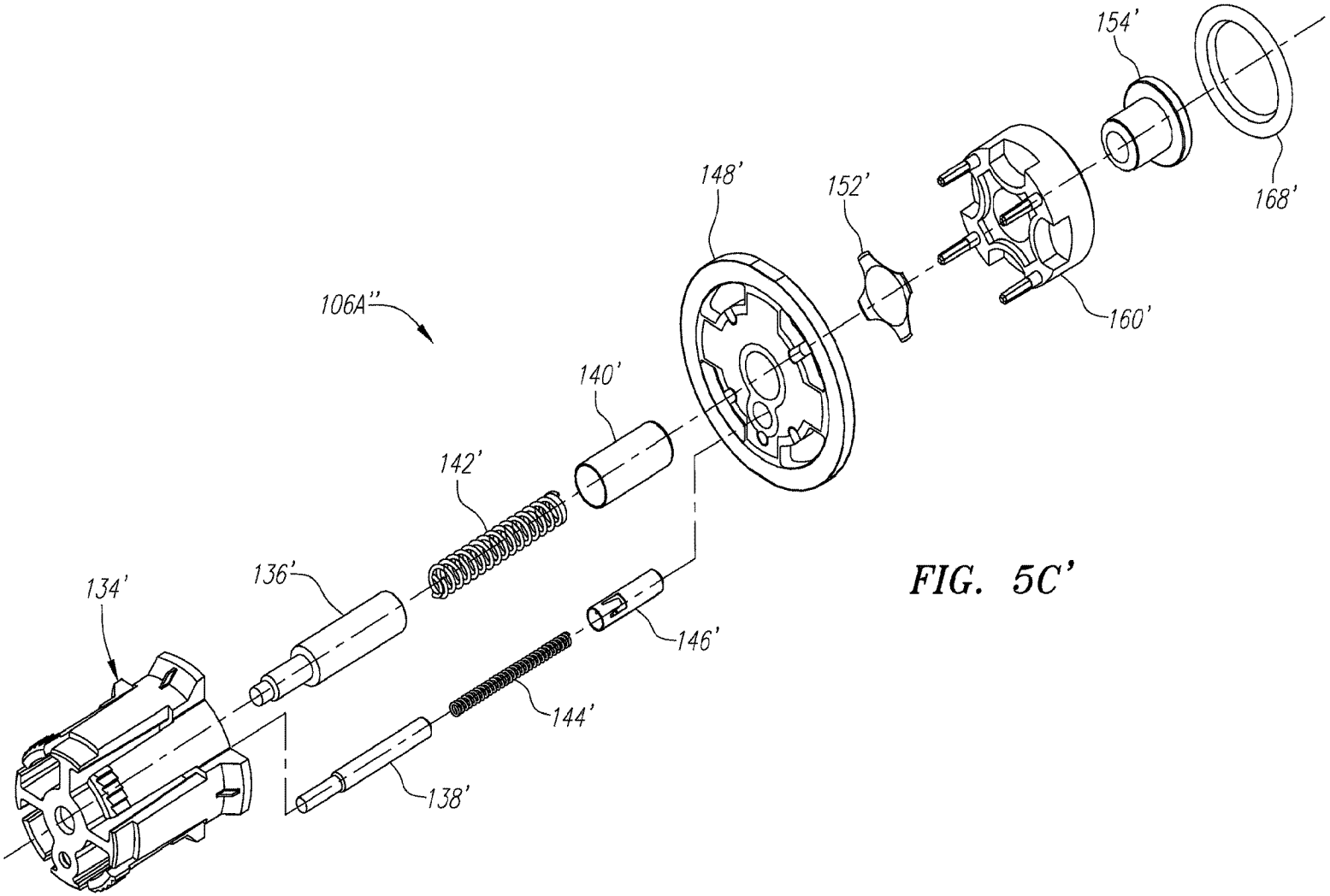
Figure 5D:
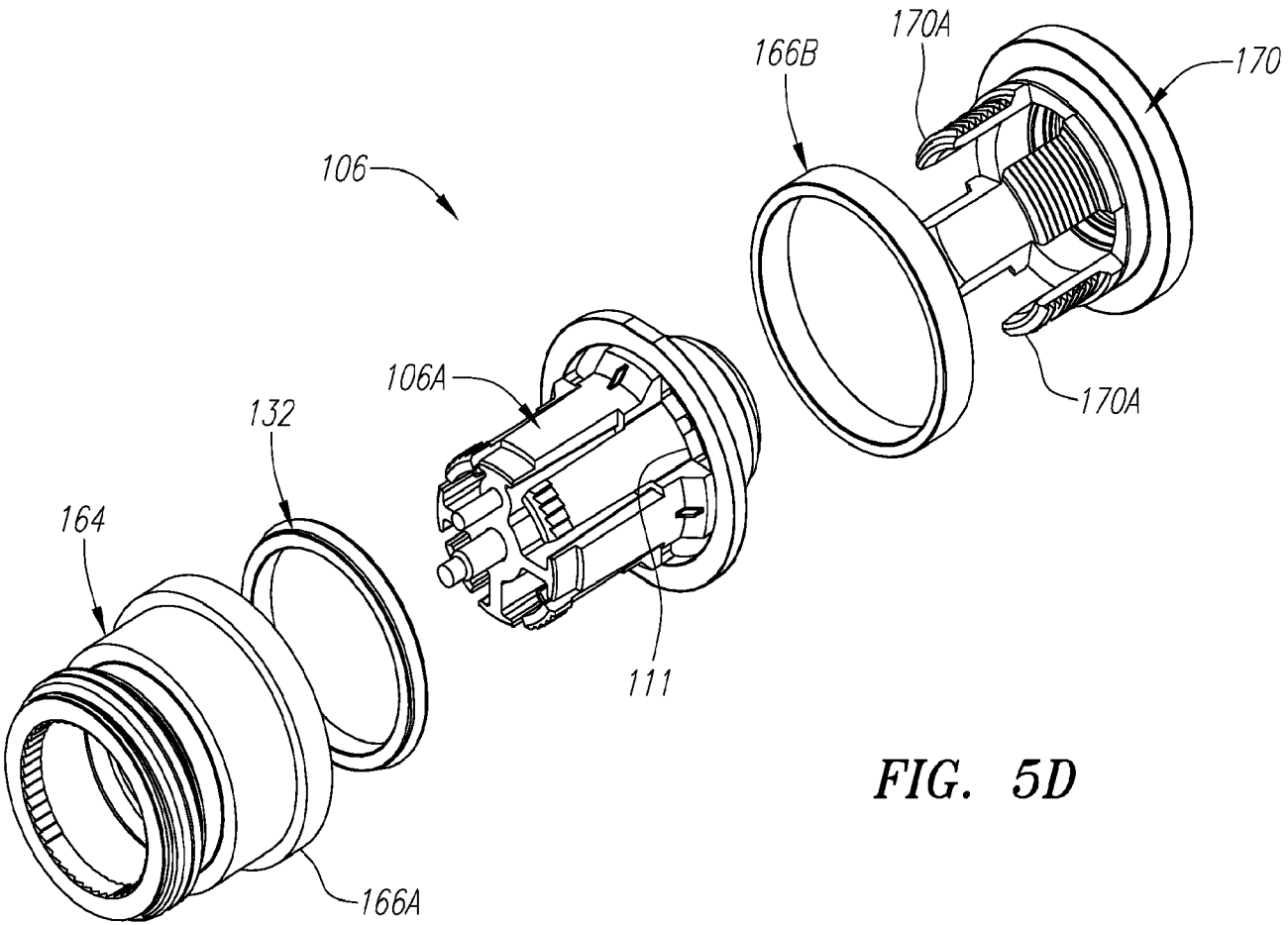
FIG. 5D is an exploded view of a tail cap assembly.
Figure 5D:
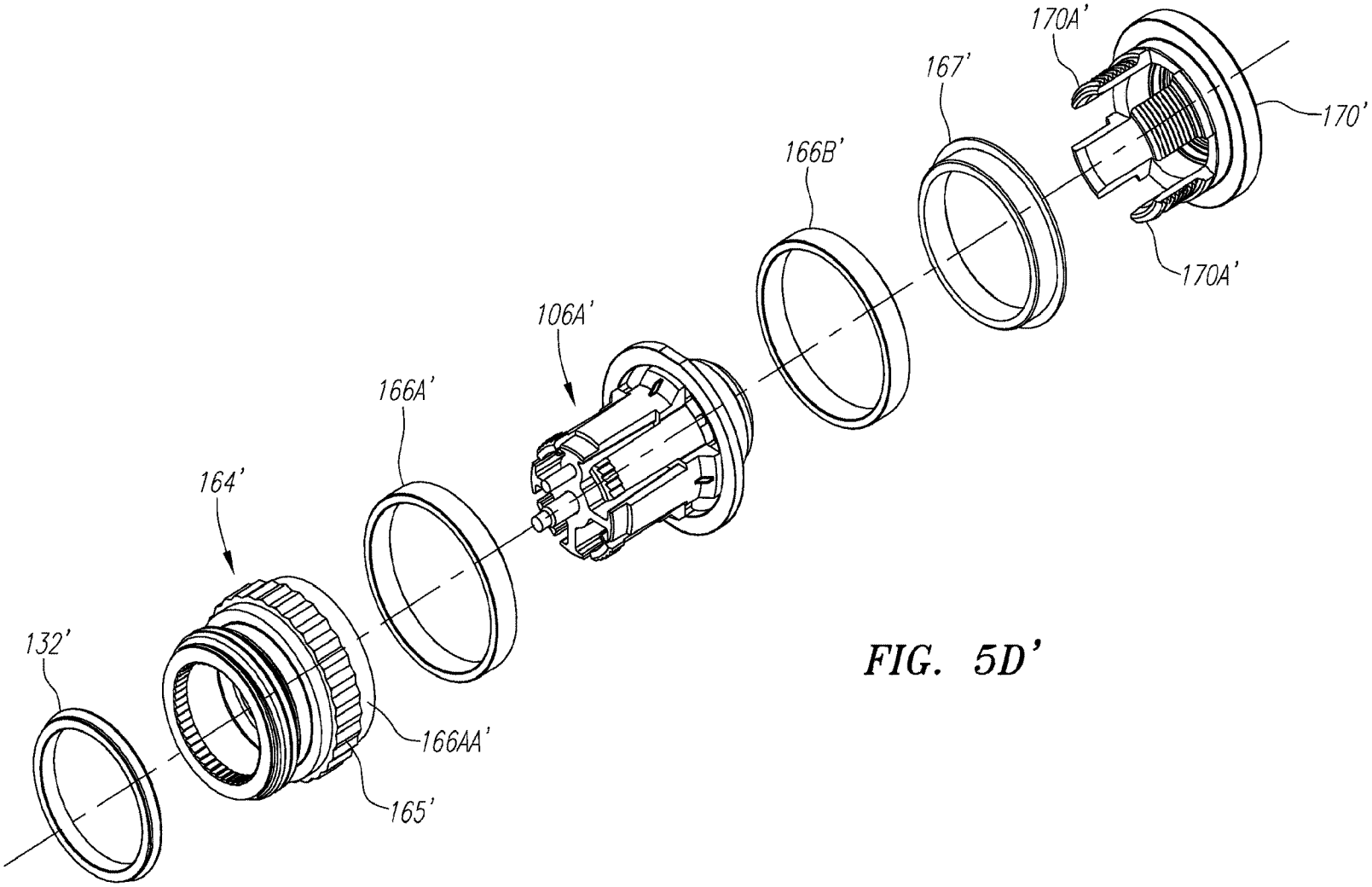

The characteristics and configurations of positive plunger 136, positive plunger spring 142 and positive plunger barrel 140, which may collectively form positive spring probe 331, are now described. The components forming positive spring probe 331 may generally be located at the centerline of flashlight 100 to engage the rearward facing positive electrode of battery 130. As best shown in FIG. 5C, positive plunger 136 may have a forward section 136*a* and a rear section 136*b* that may be joined together. The diameter of the forward section 136*a* of positive plunger 136 may be smaller than the diameter of the rear section 136*b* of positive plunger 136, and the two sections 136*a*, 136*b* may be joined together at a shoulder that transitions between the two diameters. Rear section 136*b* may include a cavity.

Positive plunger barrel 140 may generally comprise a hollow tube that may be open on the front end and closed on the rear end. The inner diameter of positive plunger barrel 140 may be slight larger than the outer diameter of the rear section 136*b* of positive plunger 136 and positive plunger spring 142 such that the rear section 136*b* and positive plunger spring 142 may fit inside positive plunger barrel 140.

Positive plunger spring 142 may fit inside positive plunger barrel 140 such that its rear end engages the closed end of positive plunger barrel 140 and its front end engages the front end of the hollow section 136*b*. In this configuration, positive plunger spring 142 may be held inside positive plunger barrel 140 and the rear section 136*b* of positive plunger 136.

In addition, positive plunger 136 may include a back cavity located generally on the back of its rear section 136*b* where positive plunger 136 may make physical contact with positive plunger spring 142 within positive plunger barrel 140. This cavity may have a circular cross-section that may have a diameter that may be slightly larger than the diameter of positive plunger spring 142 such that the front end of positive plunger spring 142 may fit inside this back cavity. In this configuration, this back cavity on the rear section 136*b* of positive plunger 136 may provide support to the junction of positive plunger 136 and positive plunger spring 142 within positive plunger barrel 140. While this back cavity has been described as having a generally circular cross-section, other shaped cross sections may be used.

Figure 4:
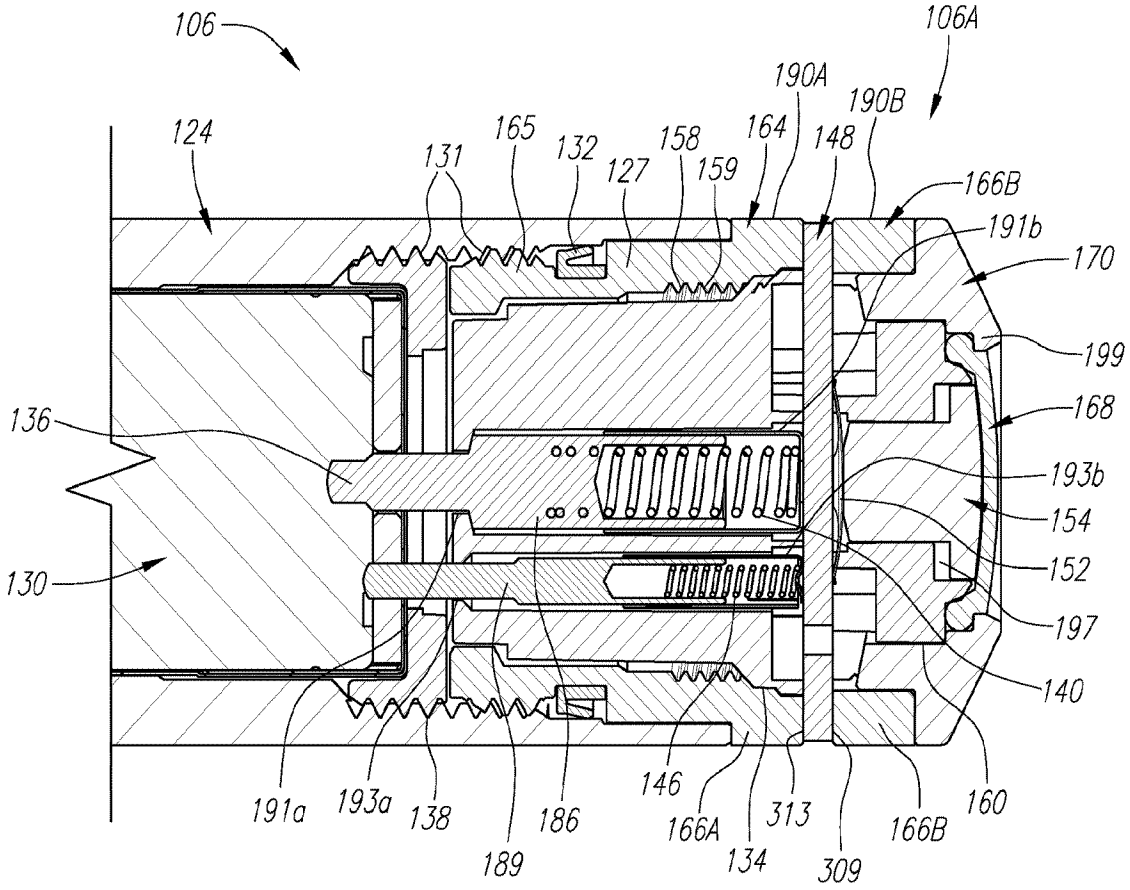
FIG. 4 is an enlarged cross-sectional view of the rear or tail section of the flashlight of FIG. 1 taken along section line A-A.
Figure 4:
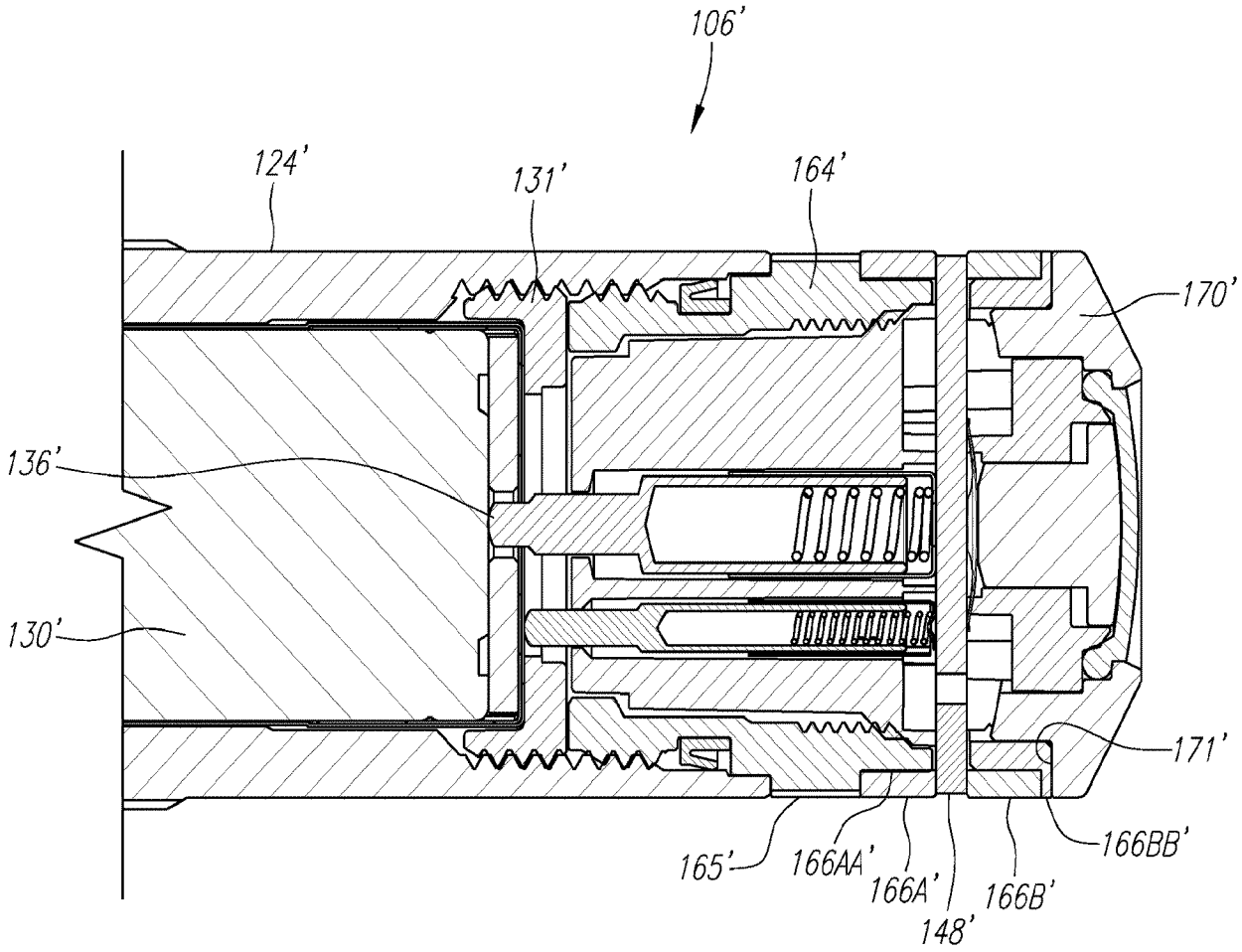
Figure 6A:
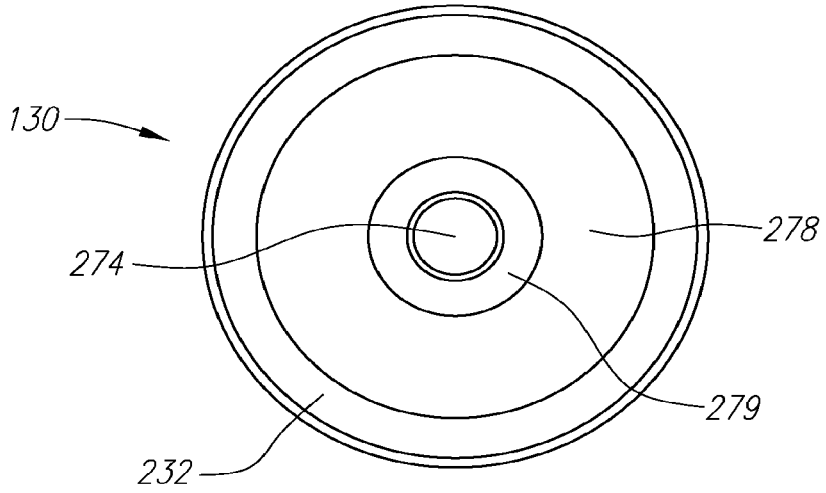
FIG. 6A is a rear view of a rechargeable battery pack.

As shown in FIGS. 4 and 5C, lower switch housing 134 may include channel 186 which may be centrally located. Central channel 186 may have forward opening 191*a* and rear opening 191*b*. The diameter of forward opening 191*a* may be slightly larger than the diameter of the forward section 136*a* and slightly smaller than the rear section 136*b*. In this manner, forward section 136*a* of positive plunger 136 may extend through forward opening 191*a* (and engage the positive electrode 274 of battery 130 as shown in FIG. 6A and discussed later), but rear section 136*b* may not; with forward opening 191*a* thereby acting as a stop to positive plunger 136 at the shoulder transition between the smaller diameter forward section 136*a* and the larger diameter rear section 136*b*.

Figure 5E:
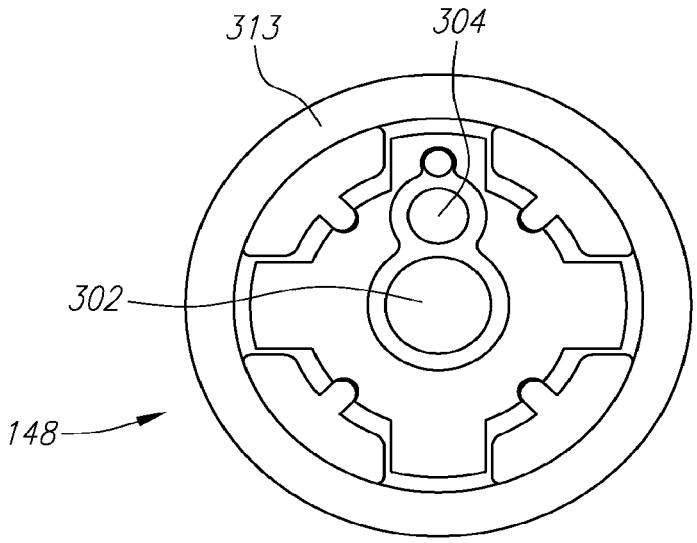
FIG. 5E is a front view of a circuit board for the tail cap assembly.
Figure 5E:
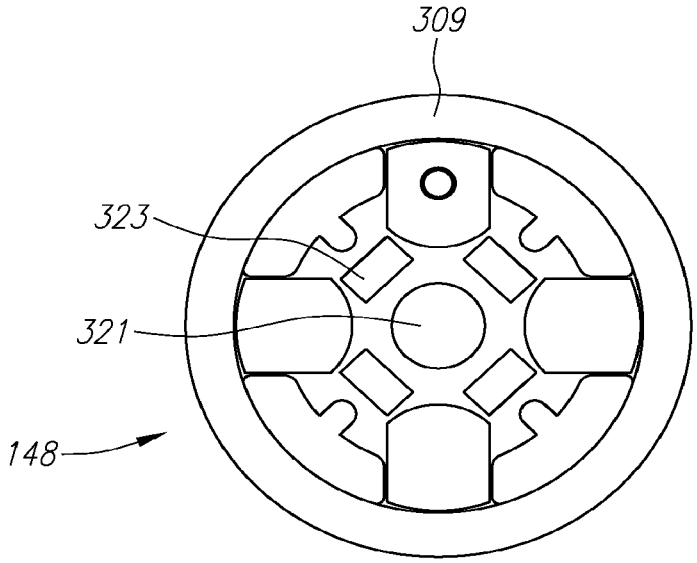

The diameter of channel 186 at rear opening 191*b* may be slightly larger than the diameter of positive plunger barrel 140 so that positive plunger barrel 140 may fit inside cylindrical channel 186 with enough clearance to move freely within cylindrical channel 186. It is preferred that the rear surface of positive plunger barrel 140 extends from rear opening 191*b* when the shoulder between forward and rear sections 136*a*,136*b* of positive plunger 136 may be engaged with forward opening 191*a*. In this configuration, the back surface of positive plunger barrel 140 may electrically contact the positive contact 302 of PCB 148 (as shown in FIG. 5E) when flashlight 100 is assembled. This will be described in more detail in later sections.

In a preferred embodiment, positive plunger spring 142 may compress when positive plunger 136, positive plunger spring 142 and positive plunger barrel 140 are configured within lower switch housing 134 and flashlight 100 is fully configured with rechargeable battery pack 130. When compressed, plunger spring 142 may thus apply forward pressure to positive plunger 136 to ensure that its front tip consistently contacts the positive contact 274 of rechargeable battery pack 130. In addition, plunger spring 142 may also exert a rearward force to positive plunger barrel 140 to ensure adequate and consistent electrical contact between its back surface and the positive contact 302 on PCB 148.

This may help prevent a break in the power circuit should flashlight 100 be dropped and battery 130 moves within barrel assembly 105. This may also help flashlight 100 withstand recoil forces and avoid power interruption when it is mounted on a firearm.

The characteristics and configurations of ground plunger 138, ground plunger spring 144 and ground plunger barrel 146, which may collectively form negative spring probe 333, are now described. As best shown in FIGS. 4 and 5C, ground plunger 138 may have forward and rear sections 138*a*, 138*b* joined together. The diameter of forward section 138*a* may be smaller than that of rear section 138*b*, and front and rear two sections 138*a*, 138*b* may be joined together at a shoulder that transitions between the two diameters.

Ground plunger barrel 146 may generally comprise a hollow tube that may be open on the front end and closed on the rear end. The inner diameter of ground plunger barrel 146 may be larger than the outer diameter of the rear section 138*b* and ground plunger spring 144 such that rear section 138*b* and ground plunger spring 144 may fit inside ground plunger barrel 146.

Ground plunger spring 144 may fit inside ground plunger barrel 146 such that its rear end engages the closed end of ground plunger barrel 144, and its front end engages the hollow section 138*b*.

Ground plunger 138 may include a back cavity located generally on the back of its rear section 138*b* where ground plunger 138 may make physical contact with ground plunger spring 144 within ground plunger barrel 144. This cavity may have a circular cross-section that may have a diameter that may be slightly larger than the diameter of ground plunger spring 144 such that the front end of ground plunger spring 144 may fit inside this back cavity. In this configuration, this back cavity on the rear section 138*b* of ground plunger 138 may provide support to the junction of ground plunger 138 and ground plunger spring 144 within ground plunger barrel 140. While this back cavity has been described as having a generally circular cross-section, other shaped cross sections may be used.

As shown in FIG. 4, lower switch housing 134 may include cylindrical channel 189 that may generally pass through lower switch housing 134 and may be located off the centerline of flashlight 100. Channel 189 may have a forward opening 193*a* and a rear opening 193*b*. It is preferred that the diameter of forward opening 193*a* is larger than the diameter of forward section 138*a*, and smaller than rear section 138*b*. In this manner, forward section 138*a* may extend through forward opening 193*a* (and engage the negative electrode 278 of battery 130 as shown in FIG. 6A) while rear section 138*b* may not. In this way, forward opening 193*a* may act as a stop to ground plunger 138 at the shoulder transition between the smaller diameter forward section 138*a* and the larger diameter rear section 138*b*.

In addition, the inner diameter of channel 189 including its rear opening 193*b* may be larger than the diameter of ground plunger barrel 146. It is preferred that ground plunger barrel 146 snugly fit inside channel 189 while still having clearance to move freely therein. It is also preferred that the back of ground plunger barrel 146 protrude through rear opening 193*b* when the shoulder between forward and rear sections 138*a*, 138*b* of ground plunger 138 are engaged with forward opening 193*a*. In this manner, the back surface of ground plunger barrel 146 may extend beyond the back of lower switch housing 134 and make electrical contact with the ground contact 304 of PCB 148 when flashlight 100 is assembled. This will be described in more detail in later sections.

In the configuration described above, ground plunger spring 144 may compress when ground plunger 138, ground plunger spring 144 and ground plunger barrel 146 are configured within lower switch housing 134 and flashlight 100 is fully configured with rechargeable battery pack 130. When ground plunger spring 144 is compressed, it may apply forward pressure to ground plunger 138 to ensure adequate and consistent electrical contact between its front tip and negative contact 276 of rechargeable battery pack 130. When compressed, ground plunger spring 144 may also apply rearward pressure to ground plunger barrel 146 to ensure adequate and consistent electrical contact between its back surface and the ground contact 304 on PCB 148. This will be described in more detail in later sections.

Lower switch housing 134 may preferably comprise a non-conductive material, such as plastic, but other suitable materials may be used. Positive plunger 136, positive plunger spring 142, positive plunger barrel 140, ground plunger 138, ground plunger spring 144 and ground plunger barrel 146 preferably comprise a conductive material so that they may form parts of the electrical paths of flashlight 100 as described later. As an example, positive and ground plungers 136, 138, and positive and ground plunger barrels 140, 146, may comprise a conductive metal, such as aluminum. Positive and ground plunger springs 142, 144 may comprise a suitable conductive spring metal, such as music wire.

Cylindrical channels 186, 189 may be positioned within lower switch housing 134 so that positive plunger 136 and ground plunger 138 may themselves be positioned to engage the positive and ground contacts of battery pack 130 and on printed circuit board 148. Specifically, when flashlight 100 is assembled, positive plunger 136 may be aligned with a bottom central contact 274 (FIG. 6A) of battery pack 130 and with positive contact 302 on PCB 148, and ground plunger 138 may be aligned with outer ring or ground contact 278 (FIG. 6A) of battery pack 130 and with negative contact 304 on PCB 148.

An alternate tail cap and switch assembly 106' is now described with reference to FIGS. 4', 5A', 5C' and 5D', where the same or similar components are shown with the same or similar reference numerals with a prime designation. In this embodiment, barrel section tail cap 164' may include knurling 165' as shown in FIGS. 5A' and 5D'. Though a longitudinal pattern is shown in the figures, knurling 165' may comprise other decorative patterns. Besides its decorative appearance, knurling 165' may assist in removing or assembling tail cap and switch assembly 106' with respect to flashlight 100'. As noted earlier, barrel section tail cap 164' may be longer than its counterpart barrel section tail cap 164. To achieve dimensional uniformity barrel section 105' may be shorter than its counterpart barrel section 105.

This embodiment of tail cap assembly 106' may also differ in that front charging ring 166A' may be separate from tail cap barrel section 164'. In this embodiment, front charging ring 166A' may fit over a recessed area 166AA' that has a diameter to accommodate the inner diameter of charging ring 166A'. In this manner, tail cap barrel section 164' may be anodized while forward charging ring 166A' may comprise nickel plating or other conductive surface.

In this embodiment, insulator 166BB' may be positioned between button section tail cap 170' and rear charging ring 166B' to isolate it from other components. More specifically, insulator 166BB' allows rear charging ring 166B' to make polarity specific contact with circuit board 148' and provides contact or isolation with other aluminum or other conductive components. Insulator 166BB' may fit over prongs 170A' and be positioned against surface 171'.

The remaining portions of tail cap and switch assembly 106' may be generally configured and operate similar to their counterparts in tail cap and switch assembly 106.

Circuit board 148 is now further described with reference to FIGS. 4, 5C, 5E and 5EE. Circuit board 148 preferably includes contacts on its front and back sides as shown in FIGS. 5E an 5EE, respectively. Circuit board 148 may also include conductive vias routed through board 148 to couple contacts on the same and/or opposite sides.

As shown in FIG. 5E, the front side of circuit board 148 (which may face lower switch housing 134) may include positive contact pad 302 to engage positive spring probe 331, and ground contact pad 304 to engage negative spring probe 333, respectively.

In addition, the front side of PCB 148 may include an outer contact 313 that may extend about its periphery, and that may serve as part of either a positive or negative (ground) electrical path. More specifically, when flashlight 100 is turned ON and operating, peripheral contact 313 may be electrically coupled to positive contact 302 and thus form part of the positive electrical path in the main power circuit to provide energy to LED 137. But when flashlight 100 is being charged, peripheral contact 313 may be electrically coupled to ground contact pad 304 and thus form part of the ground path of the recharging circuit.

Figure 7:
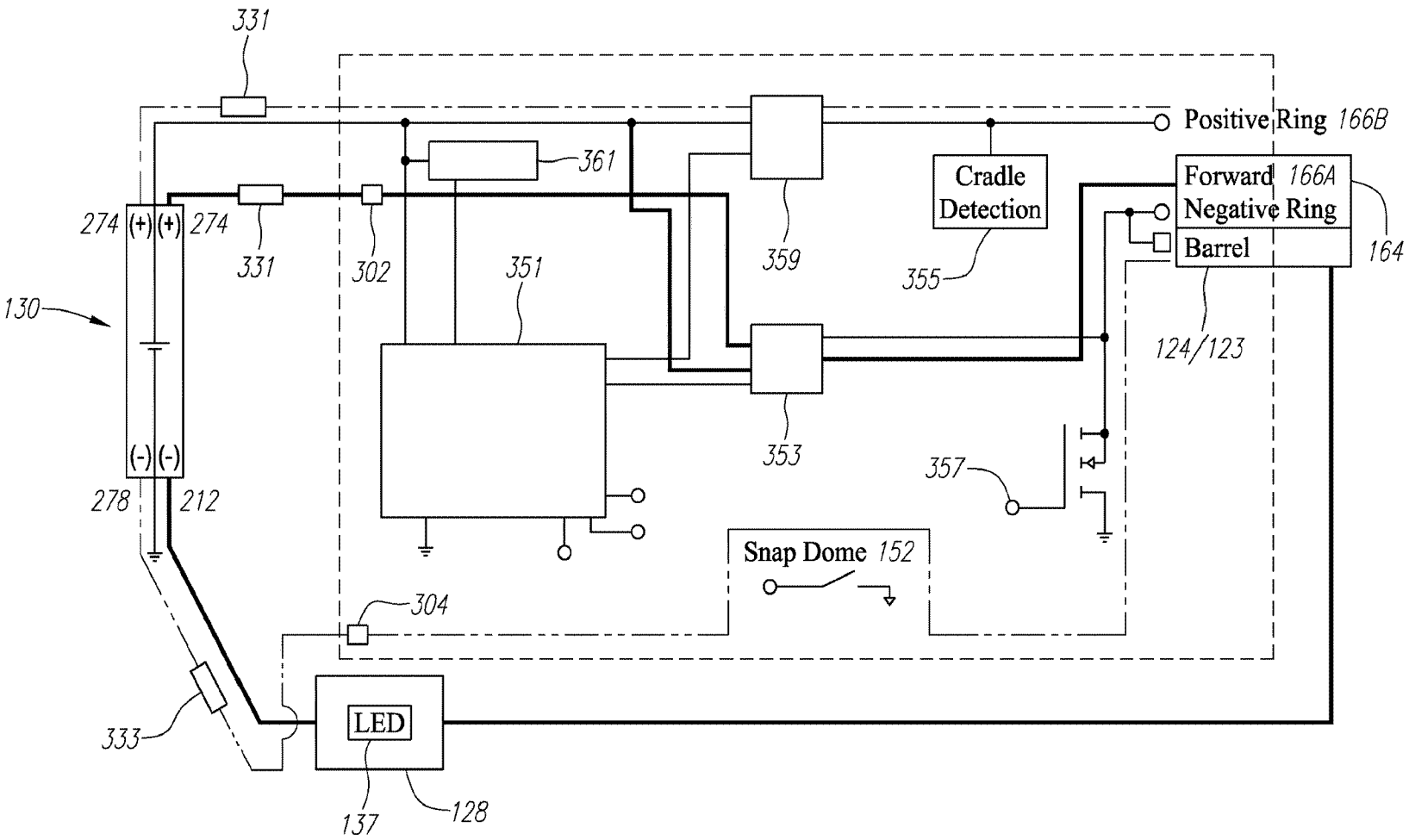
FIG. 7 is a schematic showing electrical paths to power and charge the rechargeable flashlight of FIG. 1.

As discussed in more detail below in connection with FIG. 7, PCB 148 may also include microcontroller 351, LED protection circuit 353, cradle detection circuit 355, charge enable circuit 357 and charge protection circuit 359. LED protection circuit 353 and charge enable circuit 357 may comprise MOSFET on/off switches which may be turned on or off thereby altering the electrical circuit being used in flashlight 100.

As shown in FIG. 5EE, the rear side of circuit board 148 (which may face upper switch housing 160) may include a positive contact pad 309 that may extend about its periphery and may be electrically coupled to positive contact pad 302 on the front of PCB 148. As discussed later, contact pad 309 may be used during recharging.

Circuit board 148' as shown in FIGS. 4', 5C' may be configured and function similarly to its counterpart board 148.

Switch assembly 106A is now further described with reference to FIGS. 4, 5A, 5C and 5D. Generally, switch assembly 106A may include port seal 168 which may serve as a user interface, i.e., the user may press down on seal 168 to turn flashlight 100 ON and/or switch modes of operation (as discussed later). Port seal 168 is in proximity to actuator 154 which in turn engages snap dome 152. Accordingly, when a user presses down on port seal 168, actuator 154 is also pressed down which causes snap dome to engage PCB 148 to turn flashlight 100 ON.

More specifically, upper switch housing 160 may include cylindrical channel 197 that may allow actuator 154 to axially slide within. An annular rim of switch port seal 168 may be held between an annular lip 199 of outer tail cap 170, and charging ring 166B. Snap dome 152 may include four legs that each engage a ground contact 323 on the rear side of PCB 148.

When a user presses on switch port seal 168, actuator 154 moves forward within channel 197 and engages snap dome 152 such that the middle of snap dome 152 engages ground contact 321 on the rear side of PCB 148. This serves to ground the switch 106A and turn flashlight 100 ON. The manner in which switch assembly 106A controls the operation of flashlight 100 is further described later.

Upper switch housing 160 and actuator 154 may preferably comprise a non-conductive material such as plastic. Switch port seal 168 may preferably comprise a flexible non-conductive material, such as rubber. Snap dome 152 may preferably comprise a conductive spring metal. Other suitable material may be used.

Rear charging ring 166B may be configured to include an exposed charging contact 190B, made out of metal, and preferably nickel plated, for contacting the positive contact of an external charging unit such as a charging cradle.

Rear charging contact 190B and rear charging ring 166B may electrically contact the positive contact pad 309 on the rear side of PCB 148. Positive contact pad 309 may comprise a conductive ring that generally extends around the circumference on the rear side of PCB 148 so that it contacts with rear charging ring 166B as shown in FIG. 4. As previously described, positive contact 309 may be connected to the positive contact pad 302 on the front side of circuit board 148 through vias, lines or other means. Positive contact pad 302 on the front side of circuit board 148 may electrically contact positive spring probe 331 retained in lower switch housing 134. As described above, positive spring probe 331 may be aligned to electrically contact positive electrode 274 (FIG. 6A) of battery pack 130.

The negative contact 190A of forward charging ring 166A for the charging circuit may be part of barrel section tail cap 164. Barrel section tail cap 164, including the charging contact 190A, may be preferably nickel plated. Although provided on barrel section tail cap 164, as seen in FIG. 4, charging contact 190A may form a part of the external surface of flashlight 100. Barrel section tail cap 164 may be electrically coupled to the ground contact pad 313 on the front side of PCB 148 during a recharging operation. Ground contact pad 313 may include a conductive ring that may be generally located around the circumference on the front side of PCB 148 so that it contacts barrel section tail cap 164 and charging contact 190A.

As previously described, the ground contact pad 313 may be electrically coupled to ground contact pad 304 on PCB 148, that may in turn electrically contact ground spring probe 333, that electrically contacts the ground outer contact 278 of battery pack 130. Accordingly, negative charging contact 190A may be electrically coupled to the ground outer contact 278 on the bottom of battery pack 130.

PCB 148 may be located between charging rings 166A, 166B. PCB 148 preferably comprises a non-conductive material or a non-conductive coating over a conductive material in between the locations where it may make physical and electrical contact with charging ring 166A, 166B in order to prevent shorts.

Figure 9:
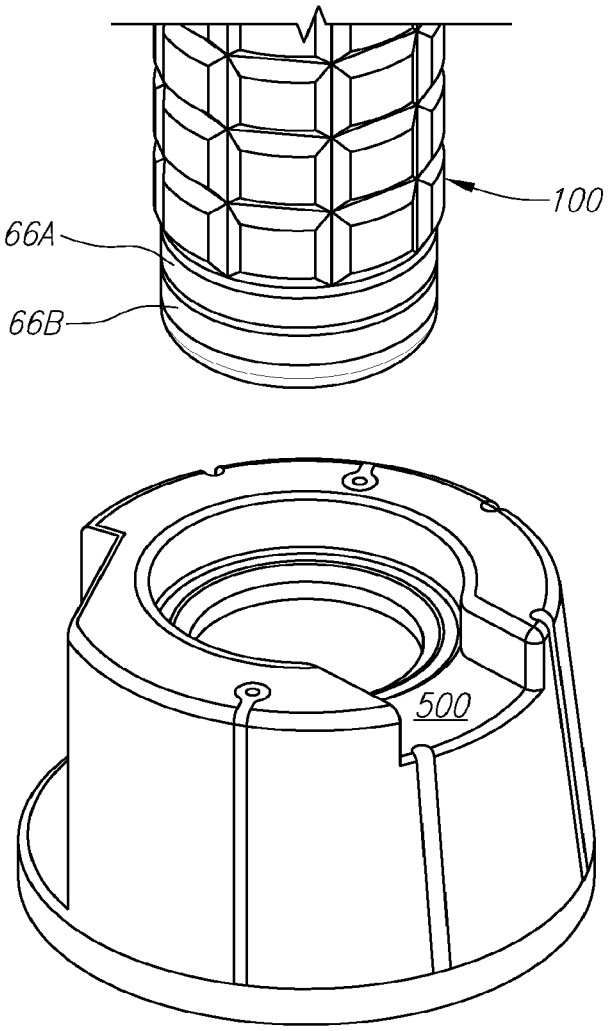
FIG. 9 is a perspective view of the rear end of a rechargeable flashlight near a charging cradle.
Figure 10:
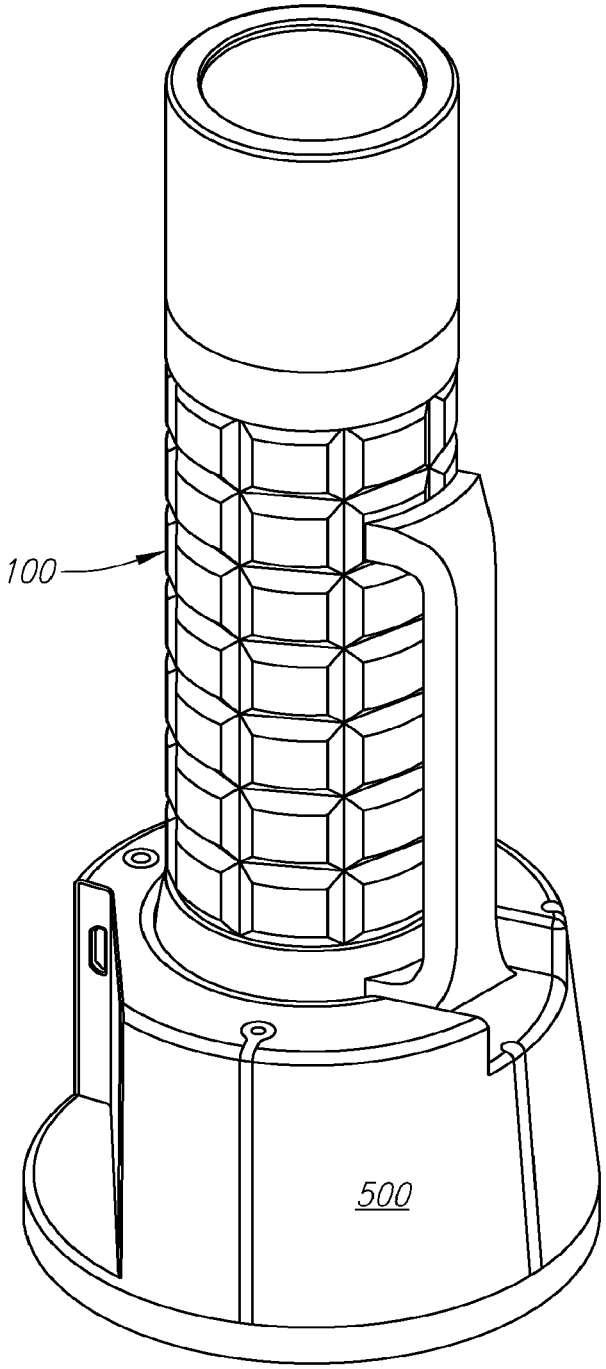
FIG. 10 is a perspective view showing the rear end of a rechargeable flashlight inserted into a charging cradle.

As shown in FIGS. 4 and 5A, charging contacts 190A, 190B may serve as the interface between an external recharging unit, e.g., cradle 500 as shown in FIGS. 9 and 10, and rechargeable battery pack 130 of flashlight 100. Cradle 500 may be designed to include charging contacts that make electrical contact with external charging contacts 190A, 190B. Cradle 500 may also hold flashlight 100 in place while charging takes place.

Charging contacts 190A, 190B of the present embodiment may preferably be in the form of charging rings to simplify the recharging procedure, i.e., to allow placing flashlight 100 in a cradle at any radial orientation. However, other forms and shapes of charging contacts may also be used.

Barrel section tail cap 164 may include exterior threads 165 on its front section for mating with interior threads 165A of rear barrel 124. With threads 165, 165A engaged as shown in FIG. 4, the front section of barrel section tail cap 164 may be inserted into and held securely within the rear portion of rear barrel 124 such that positive plunger 136 and ground plunger 138 may make electrical contact with battery pack 130 that may be configured within rear barrel 124.

A one-way valve, such as a lip seal 132, may be provided at the interface between rear barrel 124 and inner tail cap section 164 to provide a watertight seal while simultaneously allowing overpressure within flashlight 100 to vent to the atmosphere. Other forms of sealing elements, such as an o-ring, may also be used. Lip seal 132 preferably comprises a non-conductive material such as rubber.

In addition, button section tail cap 170 may include forward sections 170*a* that may include outer threads 159 as depicted in FIG. 5*c*. Forward sections 170*a* may pass through charging ring 166 and PCB 148, and may extend into grooves 111 on lower switch housing 134. Slots may be provided on PCB 148 that may allow the passage of forward sections 170*a* through PCB 148.

Barrel section tail cap 164 may preferably include threads 158 on the rear inner surface of barrel section tail cap 164 for mating with threads 159 that may be on the forward sections 170*a* of button section tail cap 170 in order to secure button section tail cap 170 barrel section tail cap 164. With button section tail cap 170 secured within barrel section tail cap 164, charging ring 166 and PCB 148 may also be secured between button section tail cap 170 and barrel section tail cap 164 as shown in FIG. 4 and FIG. 5C.

Barrel section tail cap 164 preferably comprises a conductive material such as aluminum.

It should be noted that other configurations of switch and tail cap assembly 106 may be used. For example, the switch function may be included in a side, push button switch or in an internal rotating head assembly switch such as that employed in U.S. patent application Ser. No. 12/353,396, filed Jan. 14, 2009, the contents of which are incorporated by reference as if fully set forth herein.

Switch assembly 106A' as shown in FIGS. 4', 5A', 5C' and 5D' may be configured and function similar to its counterpart switch assembly 106A.

Rechargeable battery pack 130 is now further described with reference to FIGS. 5A, 6 and 6A. In general, battery pack 130 may include a rechargeable battery and contacts or electrodes to electrically connect battery pack 130 to the rest of the flashlight 100 or other lighting device. As such, battery pack 130 may generally represent a self-contained unit that may be inserted into rear barrel 124.

Battery pack 130 has several unique features. For example, its positive electrode 274 is located at its rear end when battery pack 130 is inserted into flashlight 100. The close proximity of the positive electrode to charging rings 166A, 166B and the electronics on PCB 148 simplifies the overall electronics of flashlight 100. Furthermore, battery pack includes negative electrodes at both its front and rear ends, i.e., front negative electrode 212 and rear negative electrode 278. The existence of dual negative electrodes simplifies the configuration of the power and charging circuits described later, as well as the manner in which flashlight 100 converts between operational and charging modes.

As shown in FIG. 6, battery pack 130 may include top or negative end cap 214, label wrap 230, rechargeable battery 260, insulator disc 279 and negative contact or ring 278. These components are discussed in turn below.

Rechargeable battery 260 may comprise a Lithium Iron Phosphate ($LiFePO_4$) battery which may use $LiFePO_4$ as a cathode material. The benefits of a Lithium Iron Phosphate battery may include a longer lifetime and a higher discharge current compared to $LiCoO_2$ batteries that may be used with other light sources on the market, as well as better safety.

Rechargeable battery 260 may include front barrel 260*a* and rear barrel 260*b* as shown in FIG. 6. This two-barrel design may facilitate the construction of rechargeable battery 260 in that battery components such as electrochemical cells, internal electrical contacts and other components may be placed within one barrel, such as front barrel 260*a*, and then the rechargeable battery 260 may be sealed by attaching the second barrel, such as rear barrel 260*b*. Rear barrel 260*b* may be attached to front barrel 260*a* by spot welding, crimping, screwing or by other attachment means. It should be noted that while FIG. 6 shows front barrel 260*a* as being larger than rear barrel 260*b*, this may not be necessary.

In any event, the combination of front barrel 260*a* and rear barrel 260*b* may generally form the body of rechargeable battery 260. The top or front end of battery 260 (i.e., top or front end of front barrel 260*a*) may represent a negative contact while the bottom or rear end of battery 260 (i.e., bottom or rear end of rear barrel 260*b*) may represent a positive contact.

Negative end cap 214 may be attached to the top end of rechargeable battery 260. The top end of rechargeable battery 260 may be the anode and may have a negative polarity. End cap 214 may electrically contact the top end of rechargeable battery 260 such that electrode 212 serves as the negative terminal for rechargeable battery pack 130. Negative end cap 214 may be attached to the top end of rechargeable battery 260 by spot welding, crimping, screwing or other attachment means.

Figure 6B:
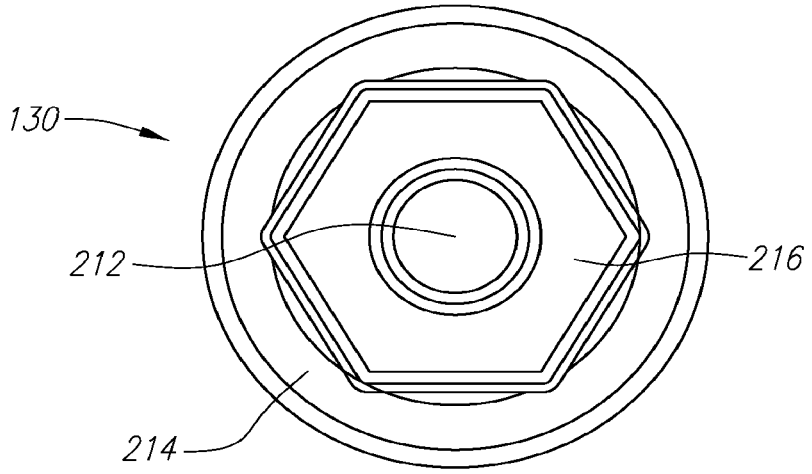
FIG. 6B is a front view of a rechargeable battery pack.

End cap 214 may also include hex nut 216 as shown in FIGS. 6 and 6B. Hex nut 216 may be used as follows. Flashlight 100 may be accompanied by a spare battery pack 130 that may also be configured as shown in FIG. 6 and include hex nut 216. The male configuration of hex nut 216 may match a corresponding female hole 131A in threaded battery nut 131, e.g., hexagonal nut engaging a hexagonal hole. As shown in FIG. 4, nut 131 may include exterior threads that engage interior threads on the rear end of rear barrel 124. When tail cap assembly 106 is removed from barrel assembly 105, nut 131 may be exposed. At this point, nut 216 of spare battery pack 130 may be inserted into hole 131A of nut 131, and spare battery pack 130 may be used as a tool to unscrew and remove nut 131, so that the installed battery pack 130 may be removed.

Figure 6C:
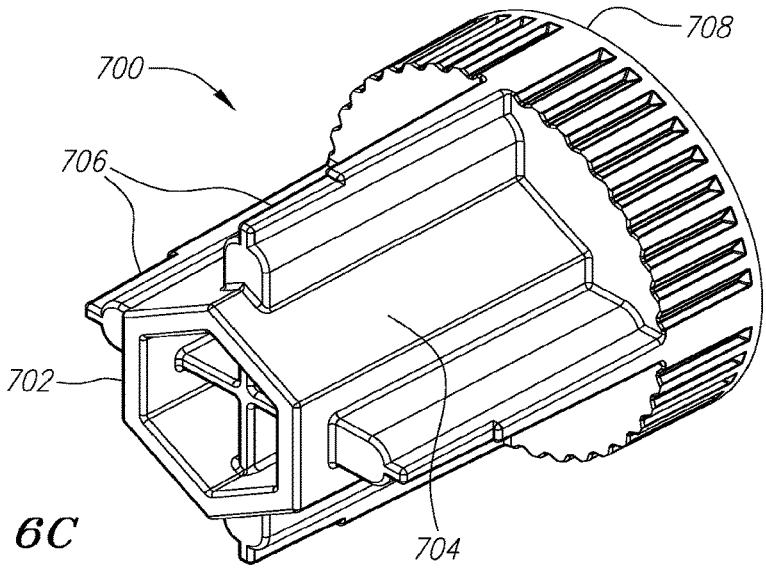
FIG. 6C is a perspective view of a battery tool.
Figure 6D:
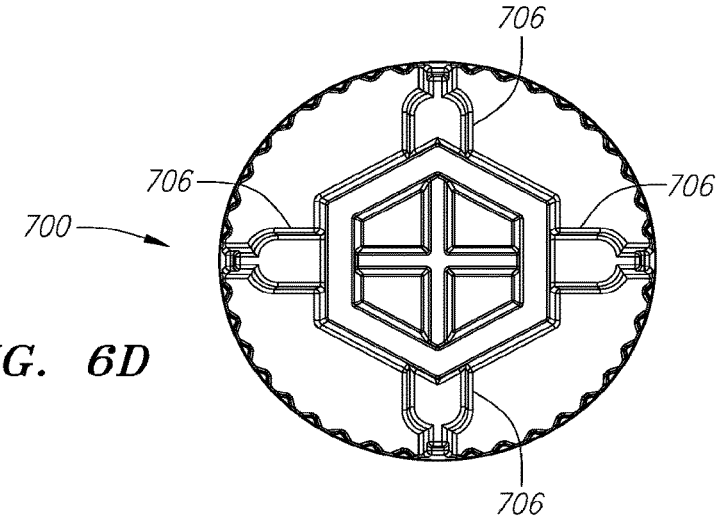
FIG. 6D is a front view of a battery tool.
Figure 6E:
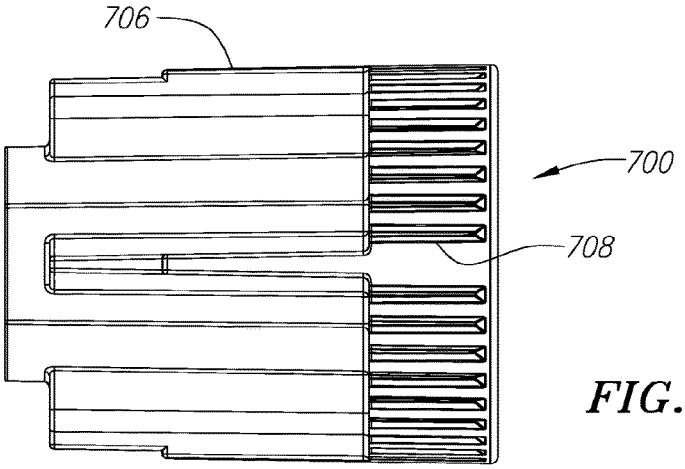
FIG. 6E is a side view of a battery tool.

As an alternative, flashlights 100, 100' may be accompanied by battery tool 700 as shown in FIGS. 6C, 6D and 6E. Tool 700 may be used to remove or install battery nut 131 when removing or installing battery pack or assembly 130. Tool 700 may include nut section 702, barrel 704, splines 706 and handle section 708. Nut section 702 may engage hole 131A of battery nut 131 in the same fashion as may nut 216 of spare battery 130. Splines 706 may extend along barrel 704 and may be sized so that their peripheral edges may be in proximity to the inner surface of rear barrel 124, 124'. In this manner, when tail cap assembly 106, 106' has been removed, tool 700 may be inserted into rear barrel 124, 124' and splines 706 may help guide nut section 702 into hole 131A, 131A' of battery nut 131, 131'. Barrel section is preferably long enough so that handle section 708 remains outside barrel 124, 124' when nut section 702 is inserted into hole 131A, 131A'. Handle section may include knurling to help the user's fingers grasp and turn tool 700.

Top or negative end cap 214 may be attached to and make electrical contact to the top negative contact of rechargeable battery 260 to preferably form the negative terminal 212 of rechargeable battery pack 130. And as shown in FIG. 6A, positive contact 274 may reside at the rear surface of battery 260 (which is not visible in FIG. 6). So at this point, battery 130 has a negative electrode 212 at its front end and positive electrode 274 at its rear end.

To provide a negative electrode at the rear end of battery pack 130, negative contact ring 278 may be attached to the back of battery 260. Negative contact ring 278 may include tabs 278*a* that may extend forward to make electrical (negative) contact with rear barrel 260*b* and front barrel

260*a*. Negative contact ring 278 may be attached to rear barrel 260*b* by spot welding, crimping, screwing or by other attachment means.

To prevent a short between positive electrode 274 and negative contact ring 278, insulator disc 279 may be located therebetween. Insulator disc 279 may generally cover the back surface of battery 260 but may also include center hole 279*a* to allow access to positive electrode 274, i.e., so that positive plunger 136 may pass through insulator disc 279 in order to make electrical contact with the positive terminal 274 of rechargeable battery 260.

In addition, negative contact ring 278 may include center hole 278*b* so that there is an amount of insulation between ring 278 and positive plunger 136 when positive plunger 136 passes through negative contact ring 278 to make electrical contact with the positive terminal 274. It is preferred that the diameter of center hole 278*b* be large enough to ensure that positive plunger 136 passes through center hole 278*b* without making electrical contact with the edges of center hole 278*b* and therefore negative contact ring 278.

Rechargeable battery pack 130 may also include a label wrap 230 that may generally encompass the foregoing components to help them remain packaged as battery pack 130. To this end, label wrap 230 may also extend over a portion of top end cap 214 as shown by lip 231, and negative contact ring 278 as shown by lip 232 in FIG. 6A. However, wrap 230 preferably does not obstruct the positive or negative contact surfaces thereof. Label wrap 230 may include markings on its surface that may contain useful information such as the make and model of battery pack 130, the serial number of battery pack 130, the polarity of each end (preferably marked with "+" and "−" icons), and other information. Label wrap 230 may also provide protection to rechargeable battery pack 130 and may electrically isolate the battery pack 130 from the environment and other components within flashlight 100. Accordingly, label wrap 230 may comprise an electrical insulator material such as Mylar or other polyester film, or other electrically insulating material.

Battery back 130 preferably has an outer diameter to fit within the inner diameter of flashlight rear barrel 124. Though battery back 130 depicted in the figures is cylindrical to accommodate flashlight rear barrel 124, battery pack 130 may be configured in other shapes to accommodate different types of lighting device housings, e.g., square or rectangular lanterns.

Battery pack 130' may be configured and operate similar to its counterpart battery pack 130.

The electrical paths of flashlight 100 are now further described with reference to FIG. 7. The electrical path when the flashlight is operating is described first, and is generally shown in FIG. 7 as the bolded line. The charging circuit is then described and is shown as the broken line.

The operational, or main power circuit, may be activated by the user pressing down on switch assembly 106A, which causes snap dome 152 to engage the center contact pad 321 on PCB 148. This in turn grounds switch 106A and turns flashlight 100 ON. At this point, the microcontroller 351 located on PCB 148 switches on the LED protection circuit 353.

With LED protection circuit 353 switched on, power flows from the positive electrode 274 of battery pack 130, through positive spring probe 331 and to positive contact pad 302 on PCB 148. Because LED protection circuit 353 is turned on, current then flows on PCB 148 to peripheral contact 313 which is in electrical contact with the forward ring 166A that forms part of tail cap barrel section 164. Because of skin cuts in the anodizing of rear barrel 124, current continues to flow from tail cap barrel section 164 through rear barrel 124, then through front barrel 123, then through housing 188 (of lighting module 128) and to LED 137 and light source 101. The ground path from LED 139 is then formed by the components of lighting module 128 as discussed earlier ending in flexible ground contact 133 which is electrically coupled to the negative front electrode 212 of battery pack 130. So in the main power circuit, forward ring 166A is electrically isolated from ground and actually acts as part of the positive path to supply current to light up LED 137.

The charging circuit may be activated by the user inserting flashlight 100 into a charging cradle 500 such as that shown in FIGS. 9 and 10. A suitable charging cradle is described in U.S. Application Ser. No. 61/879,586, filed Sep. 18, 2013, the contents of which are incorporated by reference as if set forth herein.

At this point, cradle detection circuit 355 detects that charging rings 166A, 166B are engaging electrical contacts in cradle 500, and sends a signal to microcontroller 351, which then switches on charge enable circuit 357 and charger protection circuit 359. As shown in FIG. 7, current is then provided by charging cradle 500 to rear or positive charging ring 166B. Current then flows through charger protection circuit 359 and continues to the positive spring probe 331 and then positive electrode 274 of battery pack 130 to provide a recharging function. The ground path from battery 130 then starts at rear negative electrode 278 and continues to negative spring probe 333 to the negative contact pad 304 on PCB 148. Current then flows through the charge enable circuit 357 (which had been switched on upon cradle detection thereby grounding the charging circuit). The ground path then continues to forward ring 166A which then engages the negative charging contact within cradle 500.

As can be seen by the foregoing, forward ring 166A may be shared between the main power and charging circuits. As noted earlier, ring 166A is isolated from ground when acting as part of the power circuit (because the charge enable circuit 357 is switched off), but acts as part of the ground path in the charging circuit.

Charger protection circuit 359 may protect against too large a current passing through battery pack 130 during recharging. It may also protect against reverse current, i.e., battery pack 130 being drained if cradle 500 were unplugged and flashlight 100 were left ON. Charger protection circuit 359 may comprise an off-the-shelf component such as a Fairchild load switch.

An advantage of the current invention involves the software that may be programmed into microcontroller 351. That is, microcontroller 351 may be programmed to turn on charger protection circuit 359 upon the signal being received from cradle detection circuit 355. The use of software avoids the need for additional hardware and provides flexibility.

This flexibility may also be reflected by battery monitoring circuit 361 which may also be located on PCB 148. Battery monitoring circuit 361 may generally monitor the voltage of battery pack 130 to determine the amount of charge delivered during a given recharging cycle. It may also monitor the current so that as the maximum charge capacity is neared, current is decreased. This may be accomplished by software programmed into microcontroller 351.

Flashlight 100, 100' may also include a feature where if a low battery condition exists during use, this condition is communicated to the user, so that the user knows a recharge will soon be required. This is in contrast to the light abruptly shutting off and leaving someone in the dark like many other flashlights. This may be accomplished by rapidly decreasing the brightness soon after, e.g., 0.25-0.5 seconds, turning light 100, 100' on. This allows the light to run for several minutes longer once the battery is nearly dead. This is further described in U.S. Application Ser. No. 62/033,092, filed Aug. 4, 2014, the contents of which are incorporated by reference as if fully set forth herein.

Additional flexibility provided by the software aspect of the current invention relates to the constant voltage, constant current manner of recharging. Existing rechargeable devices typically accomplish this additional circuitry. But in the current invention, microcontroller 351 may be programmed so that the recharging process may start with mostly current and little voltage. But in the current invention, microcontroller 351 may be programmed so that the recharging algorithm takes place in software. Whereas the charge process begins with constant charge-current and rising battery charge-voltage (up to a nominal battery charge-voltage level). The microcontroller will detect this nominal battery charge-voltage and begin to decrease charge-current slowly in order to maintain constant battery-voltage. The charge process is then terminated by the software programmed into microcontroller 351 when the battery is at its rated charge-voltage level at the same time that the charge-current has been decreased to 5% of the battery's nominal charge-current rating. Accomplishing this algorithm through the use of the microcontroller and programmed software, avoids the higher cost and packaging issues that could arise if it were implemented through the use of additional integrated charging circuitry or components.

The use of software to monitor charging also provides flexibility in charging parameters. For example, microcontroller 351 may be programmed to vary how long battery pack 130 may be charged, the maximum voltage and other parameters. This may aid in meeting regulations that may be imposed such as those requiring certain efficiencies.

Figure 8:
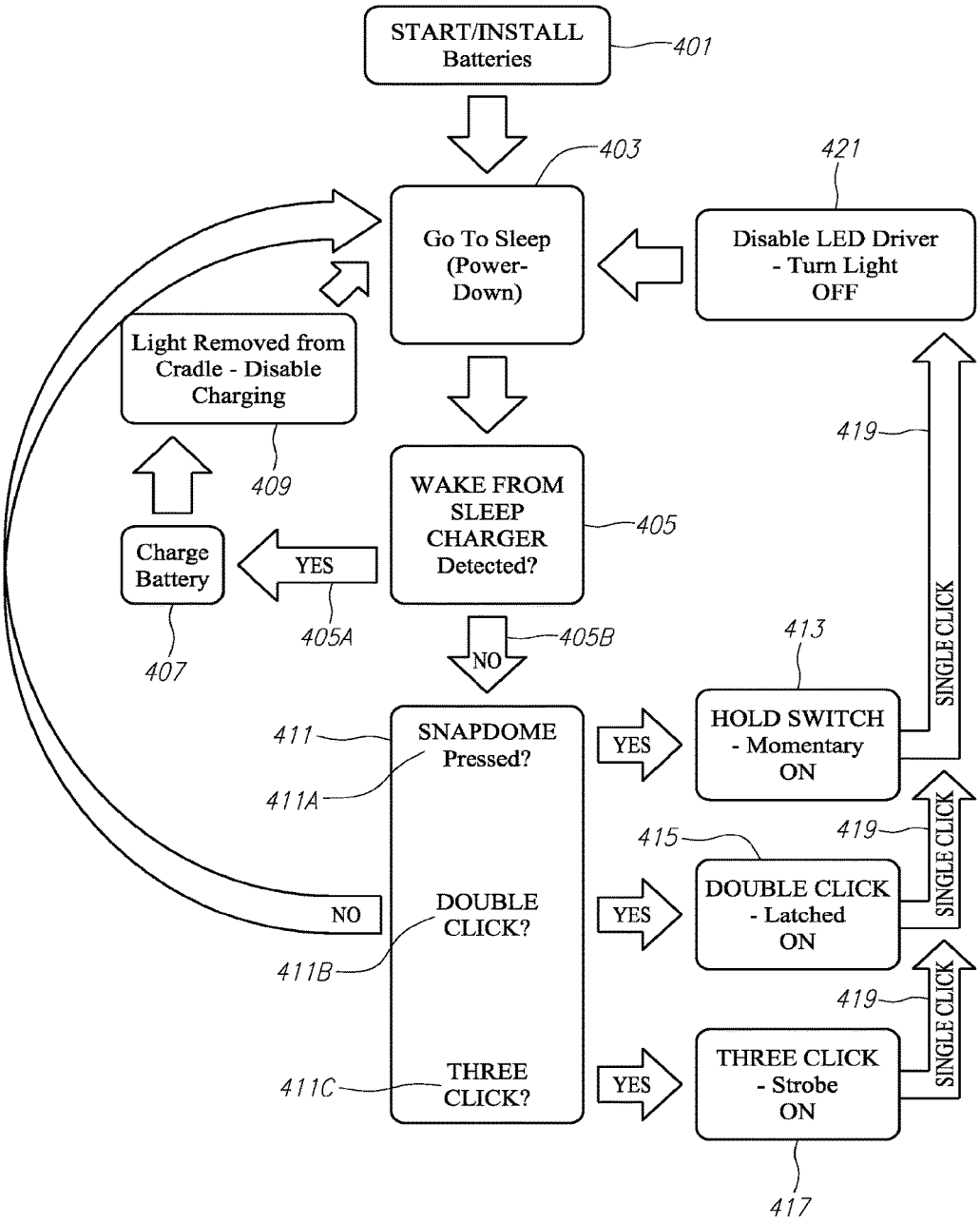
FIG. 8 is a flowchart regarding the operation and charging of a rechargeable lighting device.

The manner in which flashlight 100 may be operated is now described with reference to FIG. 8. As described below, this includes both operating flashlight 100 in various modes as well as recharging battery pack 130.

The operation may begin with step 401 in which battery pack 130 is installed in flashlight 100. Without any further action, flashlight 100 may generally exist in a sleep or power-down mode as shown in step 403.

A user may then use flashlight 100 in an operational or recharging manner. At this point, flashlight 100 may determine whether it has engaged a charging device such as cradle 500. If so, as indicated in step 405A, battery pack 130 may be charged as in step 407. As this occurs, the level of charge may be monitored, and when fully charged, flashlight 100 may be removed from cradle 500 as in step 409. At this point, flashlight 100 may again enter sleep, or power-down mode, as in step 403, if no further action is taken.

Alternatively, the user may operate flashlight 100. In this case, flashlight 100 detects whether snap dome 153 has been pressed as in step 411 so as to engage center ground contact 321 on the rear side of PCB 148.

If snap dome 153 is pressed once as in step 411A and is held down, the light may be in a momentary mode as in step 413 such that the light will turn off 421 if the switch is released. If the switch is pressed down, released and then pressed down again, i.e., double click as shown in step 411B, the light will be latched on as in step 415. A single click as in step 419 may turn the light off 421. If the switch is pressed down with three clicks as in step 411C, another mode may be accessed such as a strobe as in step 417. Other modes may be accessed. A single click 419 may turn the light off 421.

Flashlight 100, 100' may be configured so that one click provides momentary full power, two clicks provides latched full power, three clicks provides half power and four clicks provides a strobe. Other modes may be used.

The rugged nature of the lighting devices of the current invention is now further described. In certain embodiments, the current invention may be mounted on a firearm to provide illumination in tactical situations. When the weapon is fired, significant recoil may be experienced by the light, which may in turn cause the batteries to move within the housing and momentarily interrupt the circuit and cause power loss.

However, the lighting devices of the current invention may also include a mode retention and/or recovery feature which may apply as follows. In the event the lighting device is dropped or jarred by recoil, the batteries may move within the device and cause loss of power to the microcontroller. In turn, the light may shut off unless it includes a power interruption avoidance feature. To address this situation, the lighting devices of the current invention may include "bounce detection" circuitry accompanied by software that may detect battery movement and loss of power, but still allow the light to recover back into the mode it was previously in before the jarring event. This mode retention feature is discussed in U.S. application Ser. No. 13/398,611, filed Feb. 16, 2012, which is incorporated by reference as if fully set forth herein. As an alternative, it may be preferred that certain modes may change when recovered, e.g., in the example discussed above, mode 3 may revert to mode 2 when recovered.

The present invention includes a number of aspects and features which may be practiced alone or in various combinations or sub-combinations, as desired. While preferred embodiments of the present invention have been disclosed and described herein for purposes of illustration and not for purposes of limitation, it will be understood by those skilled in the art that various changes in form and detail may be made therein without departing from the spirit and scope of the invention.

What is claimed is:

1. A process for charging a rechargeable lighting device, comprising the steps of:

turning on a charging circuit when a cradle detection circuit detects that at least one of a first and a second charging contacts of the rechargeable lighting device is engaging an electrical contact when the rechargeable lighting device is inserted into a charging cradle; and controlling a charging process of the rechargeable lighting device by a software algorithm and a microcontroller configured within the rechargeable lighting device;

wherein the rechargeable lighting device has a housing which contains a switch, a rechargeable power source and the microcontroller;

wherein the first and the second charging contacts are located on the exterior of the rechargeable lighting device; and wherein the first charging contact is part of a main power circuit that powers a light source of the rechargeable lighting device and is isolated from a charging ground path when the main power circuit is turned on and the charging circuit is not turned on but acts as part of the charging ground path when the charging circuit is turned on.

2. The process of claim 1 wherein the charging process begins with a charge-current which is constant and a battery charge-voltage which rises up to a nominal battery charge-voltage.

3. The process of claim 1 wherein the microcontroller can be programmed to vary a parameter of the charging process.

4. The process of claim 1 wherein the rechargeable lighting device recovers to a preselected condition through use of a power interruption avoidance algorithm configured within the microcontroller when there is a loss of power to the microcontroller of less than a preselected amount of time.

5. The process of claim 2 wherein the microcontroller detects the nominal battery charge-voltage and the software algorithm slowly decreases the charge-current in order to maintain the battery charge-voltage constant.

6. The process of claim 3 wherein the parameter is a length of time the rechargeable power source is charged.

7. The process of claim 3 wherein the parameter is a maximum battery charge-voltage.

8. The process of claim 4 wherein the preselected condition is a mode of operation in which the rechargeable lighting device was operating before the loss of power to the microcontroller.

9. The process of claim 4 wherein the preselected condition is a mode of operation in which the rechargeable lighting device was not operating before the loss of power to the microcontroller.

10. The process of claim 5 wherein the charging process is terminated by the software algorithm when the rechargeable power source is at a rated charge charge-voltage level at the same time that the charge-current has been decreased to a preselected level of a nominal charge-current rating of the rechargeable power source.

11. The process of claim 10 wherein the preselected level is 5%.

12. A process for operating a rechargeable lighting device, comprising the steps of:

causing the rechargeable lighting device to change from a sleep mode to a wake from sleep mode by either activating a switch or inserting the rechargeable lighting device into a charging cradle; and when change to the wake from sleep mode is caused by activation of the switch, turning on a main power circuit that powers a light source of the rechargeable lighting device, or when change to the wake from sleep mode is caused by inserting the rechargeable lighting device into the charging cradle, turning on a charging circuit when a cradle detection circuit detects that at least one of a first and a second charging contacts is engaging an electrical contact in the charging cradle;

wherein the rechargeable lighting device has a housing which contains the light source and the switch;

wherein a rechargeable power source is held within the housing;

wherein the first and the second charging contacts are located on the exterior of the rechargeable lighting device; and wherein the first charging contact is part of the main power circuit and is isolated from a charging ground path when the main power circuit is turned on and the charging circuit is not turned on but acts as part of the charging ground path when the charging circuit is turned on.

* * * * *